US008573896B2

(12) United States Patent
Relin et al.

(10) Patent No.: US 8,573,896 B2
(45) Date of Patent: Nov. 5, 2013

(54) METHOD OF DYNAMIC ENERGY-SAVING SUPERCONDUCTIVE TRANSPORTING OF MEDIUM FLOW

(75) Inventors: Arkadi Relin, Langhorne, PA (US); Ion Marta, Philadelphia, PA (US)

(73) Assignee: REMCO International, Inc.

( * ) Notice: Subject to any disclaimer, the term of this patent is extended or adjusted under 35 U.S.C. 154(b) by 204 days.

(21) Appl. No.: 12/287,771

(22) Filed: Oct. 15, 2008

(65) Prior Publication Data

US 2009/0103989 A1 Apr. 23, 2009

Related U.S. Application Data

(60) Provisional application No. 61/137,106, filed on Jul. 28, 2008, provisional application No. 61/069,329, filed on Mar. 14, 2008, provisional application No. 61/065,250, filed on Feb. 11, 2008, provisional application No. 61/006,148, filed on Dec. 26, 2007, provisional application No. 61/007,628, filed on Dec. 14, 2007, provisional application No. 60/999,107, filed on Oct. 17, 2007.

(51) Int. Cl.
*B65G 53/00* (2006.01)

(52) U.S. Cl.
USPC ..... 406/197; 406/10; 406/12

(58) Field of Classification Search
USPC ..... 406/197, 10, 12
See application file for complete search history.

(56) References Cited

U.S. PATENT DOCUMENTS

| | | | | | |
|---|---|---|---|---|---|
| 3,568,760 | A | * | 3/1971 | Hogel | 165/216 |
| 3,589,602 | A | * | 6/1971 | Cushman | 236/98 |
| 3,710,762 | A | * | 1/1973 | Wendel et al. | 119/844 |
| 3,982,789 | A | * | 9/1976 | Funk | 406/105 |
| 4,239,449 | A | * | 12/1980 | Bauer | 415/73 |
| 4,251,365 | A | * | 2/1981 | Speece | 261/121.1 |
| 4,325,476 | A | * | 4/1982 | Eddy | 198/448 |
| 4,401,402 | A | * | 8/1983 | Casperson | 414/218 |
| 4,402,635 | A | * | 9/1983 | Maruo | 406/14 |
| 4,592,679 | A | * | 6/1986 | Boiting et al. | 406/127 |
| 4,674,922 | A | * | 6/1987 | Federhen et al. | 406/126 |
| 4,795,315 | A | * | 1/1989 | Schultze | 417/68 |
| 4,936,716 | A | * | 6/1990 | Anderson | 406/168 |
| 4,946,650 | A | * | 8/1990 | Rothele | 422/68.1 |
| 4,992,623 | A | * | 2/1991 | Briley et al. | 505/220 |
| 5,026,171 | A | * | 6/1991 | Feller | 374/41 |
| 5,026,275 | A | * | 6/1991 | Hundebol | 432/14 |
| 5,176,475 | A | * | 1/1993 | Brannstrom | 406/191 |
| 5,201,877 | A | * | 4/1993 | Relin et al. | 406/85 |
| 5,240,355 | A | * | 8/1993 | Hudalla | 406/95 |
| 5,296,015 | A | * | 3/1994 | Becerra-Novoa et al. | 75/10.66 |
| 5,358,467 | A | * | 10/1994 | Milstein et al. | 601/10 |
| 5,502,658 | A | * | 3/1996 | Relin | 702/142 |
| 5,593,252 | A | * | 1/1997 | Relin et al. | 406/85 |
| 5,718,539 | A | * | 2/1998 | Segota | 406/61 |
| 5,816,313 | A | * | 10/1998 | Baker | 165/41 |

(Continued)

*Primary Examiner* — Joseph Dillon, Jr.

(57) ABSTRACT

In a method of dynamic energy-saving superconductive transporting of medium flow, a modulated flow-forming action is applied to the medium from an action element for providing a modulated process of flow transporting in a given direction, and a frequency, a drop-shaped form of a law with a range and a comparative phase of a negative modulating of the action are predetermined so that a minimal value of the energy ratio of a controlled acting value of a modulated flow-forming energy of the action to a controlled acting value of a kinetic energy formed in the modulated medium flow during the flow transporting is provided.

5 Claims, 8 Drawing Sheets

(56) References Cited

U.S. PATENT DOCUMENTS

| | | | | |
|---|---|---|---|---|
| 5,863,155 | A * | 1/1999 | Segota | 406/61 |
| 5,865,568 | A * | 2/1999 | Relin et al. | 406/85 |
| 5,924,854 | A * | 7/1999 | Blume et al. | 418/83 |
| 5,996,516 | A * | 12/1999 | Benneweis et al. | 111/176 |
| 6,827,528 | B1 * | 12/2004 | Relin | 406/12 |
| 6,948,315 | B2 * | 9/2005 | Kirby et al. | 60/653 |
| 6,994,497 | B1 * | 2/2006 | Eriksson et al. | 406/124 |
| 7,114,889 | B2 * | 10/2006 | Kanou et al. | 406/14 |
| 7,150,778 | B1 * | 12/2006 | Dauber et al. | 95/8 |
| 7,556,455 | B2 * | 7/2009 | Relin | 406/12 |
| 2009/0007847 | A1 * | 1/2009 | Relin | 119/14.02 |
| 2009/0149928 | A1 * | 6/2009 | Relin | 607/96 |

* cited by examiner $[b_{m1(opt)}; l_{m1(opt)}; \alpha_{m1(opt)}]$ $[b_{m1(opt)}; l_{m1(opt)}; \alpha_{m1(opt)}]$ $[b_{m1(opt)}; l_{m1(opt)}; \alpha_{m1(opt)}]$

METHOD OF DYNAMIC ENERGY-SAVING SUPERCONDUCTIVE TRANSPORTING OF MEDIUM FLOW

TECHNICAL FIELD

The present invention relates to methods and devices which provide transporting of an object with a flow of a carrying medium. It encompasses a broad class of systems which are used, for example: in industry; in energy-interacted systems; in pipelines, ground, air, above water, underwater and other types of transportation; in medical and household technique; in converting and special technique; in special destructive and explosive technique; in research devices and systems; in physiological systems and in other areas. Presently this broad class of such systems under consideration represents one of the most important fields of global energy consumption.

BACKGROUND ART

Various methods and devices are known which provide transporting of objects with a flow of a carrying medium. A common traditional methodological approach, which is used in various systems in the above-mentioned class, is the application of an action to the above-mentioned carrying medium by an action means. It creates a process of conversion of energy supplied to it and integrally constant in time action so that the above-mentioned flow of the carrying medium created in this way acts on the above-mentioned object to transport it in a given direction. This approach is realized in various systems, which use mainly two types of means for action. First means is the means of pressure drop: pumps; screws, turbines, turbo reactive and reactive systems; explosive devices of pumping or vacuum action; means of action, which use a forced aerodynamic or hydrodynamic interaction of the object or its structural part, correspondingly with gaseous or liquid medium, for example a region of an outer surface of a casing of a flying, fast moving apparatus on the ground or underwater etc. Second means is the means for direct energy action: magneto and electrohydrodynamic pumps; magnetic and electromagnetic acceleration systems etc. The object can be structurally not connected or structurally connected (for example in a flying apparatus) with the action means. In some cases the object is a flowable medium and performs a function of a carrying medium (for example gas or liquid product such as oil transported in a pipeline). In various known action means, the energy which is supplied to them and is converted in them can be of various types, such as for example: electrical, electromagnetic, magnetic, mechanical, thermal energy; energy generated as a result of a chemical reaction, a nuclear reaction, a laser action etc.; or for example energy generated during operation of a physiological system; or energy generated during a forced aerodynamic interaction of an object with a gaseous medium or during a forced hydrodynamic interaction of an object with a liquid medium. In some known action means, as the supplied energy, a combination of several different types of energies is utilized (for example, a combination of magnetic and electrical energy as in a magneto and electrohydrodynamic pumps). A typical carrying medium is gas or liquid.

The object of transportation can be for example: powder or granular material; gaseous or liquid medium; excavated product (coal, ore, oil, gas, gravel etc.); a mixture of materials; a component or refuse of manufacturing; fast movable or immovable objects; physiological or physical substance; and many others.

Common disadvantages of the traditional methodological approach, which is realized in such systems for providing of a process of transporting an object with a flow of a carrying medium, are as follows:

- limited possibilities for reduction of specific consumption of energy for providing the process of transporting of the objects;
- impossibility of performing efficient dynamic control of the process of transporting with the purpose of optimization of its energy characteristics;
- presence of negative side effects which accompany work of some of such systems and significantly worsen their operation and energy characteristics (for example: "sticking" during suction; adhesion of particles on inner walls or clogging of a portion of a canal which limits the transported flow; a fast clogging of filtering devices, which operate in a multi-phase flow; and so on).

The above-listed disadvantages significantly increase energy consumption and therefore reduce an economic efficiency of application of such traditional systems for providing the process of transporting of an object by a flow of a carrying medium.

Other methods and devices for dynamic transporting of an object with a flow of a carrying medium are known, as disclosed for example in U.S. Pat. Nos. 5,201,877 (1993), 5,593,252 (1997) and 5,865,568 (1999)—A. Relin, et al. The above-mentioned methods and devices realize a methodological approach, which was first proposed by Dr. A. Relin in 1990 and utilizes a modulating of a suction force, performed outside of the action means by connection of an inner cavity of a suction area of a transporting line with atmosphere through a throughgoing passage and simultaneous periodic change of an area and shape of the throughgoing passage during transporting of the object. The use of this approach (which is named by Dr. A. Relin "AM-method"), which realizes the "Principle of controlled exterior dynamic shunting" of the suction portion proposed by the author, opens qualitatively new possibilities for significant increase of efficiency of operation and exploitation of a certain class of devices and systems for suction transporting of various objects. In particular, the use of a negative modulating of the suction force over a limited suction portion of movement of the flow in a closed passage as in vacuum cleaning systems, in various medical suction instruments and also in pneumo transporting systems of various materials and objects, allows minimization and even complete elimination of the above-mentioned common disadvantages which are inherent to known traditional approach realized in the known systems of this type.

However, the necessity and possibility of performing the connection of the interior cavity of only the suction portion of the transporting line (outside of the above-mentioned action means) with the atmosphere through the throughgoing passage does not allow the use of this principle of modulation in a broad class of other types of known devices and systems that provide a process of transporting an object with the flow of a carrying medium:

- which does not allow a contact with atmospheric medium of the object transported in the closed passage, for example various gasses, chemical and physiological materials and media;
- which does not allow an entraining of atmospheric medium (for example air) into a hydrotransporting system which can lead to cavitation effects damaging the pipeline and the hydraulic pump and also can cause additional energy losses;
- which does not allow a possibility of performing a connection of the inner cavity of the pumping line of transportation with atmosphere through the throughgoing passage, causing expelling of the transporting medium into atmosphere;

which provides identical speed characteristics over the whole extension of the movable flow: both at its suction portion and its pumping portion;

which does not allow a possibility of realization of such approach due to absence of a closed long suction portion of the passage during use of various types of above-mentioned action means acting on the carrying medium with a pressure drop, for example: connected with the object of transporting—screw, turbine, turbo reactive and reactive systems; various explosive devices; action means, which use forced aerodynamic and hydrodynamic action of the object, correspondingly, with gaseous and liquid medium; and other similar types of action means;

which does not provide a pressure drop with the action means used in them, realizing other principles of performing of the above-mentioned action, for example during the use of the above-mentioned means of direct energy action.

In addition, during development of the construction of the modulator which realizes the above-mentioned "Principle of controlled exterior dynamic shunting" of the suction portion it is necessary to solve additional problems, for example: connected with reduction of level of additional noise caused during a periodic connection of the atmospheric medium with the internal cavity of the suction portion of the transporting line; and effects connected with protection of the throughgoing passage for connection of the modulator from possible sucking into it of various components of an external medium or foreign objects.

Attempts to take into consideration these factors in such cases additionally complicate and make more expensive the construction and the operation of the modulator.

The above-explained disadvantages significantly limit the possibilities for solution of real problems connected with energy optimization of processes of transporting of an object with a flow of a carrying medium, and also areas of application of the above analyzed efficient methodological approach, which uses the negative modulation of the suction force over the suction portion, performed with the use of the above-mentioned "Principle of controlled exterior dynamic shunting".

Other methods and devices for dynamic transporting of an object with a flow of a carrying medium are known, as disclosed for example in U.S. Pat. No. 6,827,528 (2004)—A. Relin. The fundamentally new method (which is named by the inventor "R-method") is based on works of Dr. A. Relin and confirmed by scientific research of concepts of a new theory "Modulating aero- and hydrodynamics of processes of transporting objects with a flow of a carrying medium". These scientific concepts consider new laws which are developed by the author and connected with a significant reduction of a complex of various known components of energy losses (and therefore of specific consumption of energy) during creation of a dynamically controlled process of movement of the flow of a carrying medium with a given dynamic periodically changing sign-alternating acceleration during the process of transporting of the above-mentioned object.

The dynamic method minimizes or completely eliminates the above-mentioned disadvantages in providing an efficient process of transporting of an object with a flow of a carrying medium, which are inherent to the known traditional methodological approach and the above-mentioned second approach, which uses the negative modulation of suction force based on the "Principle of controlled exterior dynamic shunting" of the suction portion. High-energy efficiency of said dynamic method is obtained due to the fact that it solves a few main problems:

provides minimization of negative dominating influence of turbulence on losses of kinetic component of the applied energy in a zone of a boundary layer and in a nucleus of the flow of a carrying medium during the process of transporting of an object;

provides minimization of various components of energy losses connected with the process of transporting of the object itself by the flow of a carrying medium during whole period of this process;

provides possibility of a given multi-parameter dynamic control of the process of transporting of an object with a flow of a carrying medium during its whole realization;

provides possibility of significant reduction of integral value of energy action applied to the above-mentioned flow and as a result, provides practically analogous significant reduction of consumption of the supplied energy which is converted (consumed) by the action means acting on the flow;

provides possibility of dynamic consideration of characteristics (criteria) of the process of transporting of an object with the flow of carrying medium for optimization of the given multi-parameter dynamic control by executing this process with the purpose of increasing its energy efficiency.

The method of dynamic transporting of an object with a flow of a carrying medium includes the following steps:

In a conveyor, comprising a cyclic drive means transporting a fluid medium having at least one object entrained therein through an enclosed passage, said drive means interposed between upstream and downstream segments of said passage and comprising a first working zone in a negative drive cycle and a second working zone in a positive drive cycle, the method of optimizing at least one value of said object entrained fluid medium characteristic of said transporting of said object entrained fluid medium with respect to drive means energy consumption comprising: providing at least one shunt passage from said second working zone to said first working zone; flowing said object entrained fluid medium through said shunt passage from said second working zone to said first working zone thereby changing said at least one value of said object entrained fluid medium and the difference in magnitude between said cycles; modulating the flow through said shunt passage to optimize said at least one value with respect to drive means energy consumption.

As the above-mentioned cyclic drive means (or action means), either a means of pressure drop or a means of direct energy action can be utilized. The method embraces all possible spatial conditions of the transporting object. In some cases the object can be a flowable medium and in this case can perform a function of the above-mentioned carrying medium. In other cases the object can be structurally not connected or structurally connected with the action means in the process of its transporting. In certain situations a structural part of the object can perform a function of a converting element of the action means so as to provide the process of conversion of energy supplied to it and generated during forced interaction of this structural part of the object with the flowable medium.

Another important feature of said invention is that the above-mentioned given modulation of the value of the action in the action means is performed by providing a given dynamic periodic change of the value of a parameter which is dynamically connected with the process of conversion in the action means of the energy supplied to it, into the action with simultaneous given change of the value of this parameter in each period of its change during the process of transporting of the object. This approach can be used both in the case of utilization of the pressure drop action means and in the case of utilization of the direct energy action means.

As the parameters of the process of conversion of the supplied energy the following parameters can be utilized, for example: electrical, electromagnetic, magnetic, structural, technical, physical, chemical or physical-chemical parameter, or a combination of various types of these parameters. As the energy supplied to the action means, the following energy for example can be used: electrical, electromagnetic, magnetic, mechanical, thermal energy; energy generated as a result of performing of chemical or nuclear reactions; energy generated during operation of a physical system; energy of forced aerodynamic interaction of a structural part of the object with a gaseous medium (performing the function of the action means); energy of forced hydrodynamic interaction of the structural part of the object with liquid medium (performing the function of the action means); or it can use a combination of several types of the supplied energy.

In accordance with another feature of said invention, the given modulation of the value of the action in the pressure drop means is performed by providing a simultaneous given dynamic periodic change in working zones of the pressure drop means, correspondingly, of a value of a negative overpressure and a value of a positive overpressure with their simultaneous change in each period of the change of the above-mentioned values of the actions, generated in the process of conversion of the energy supplied to the pressure drop means in the working zones. These zones are in contact with the carrying medium, so as to provide application of the generated given dynamic periodic action determined by the above-mentioned values of the negative and positive overpressures during the process of transporting of the object.

The simultaneous given dynamic periodic change in the working zones of the pressure drop means and correspondingly of the value of negative overpressure and the value of positive overpressure with their simultaneous change in each period of the change of the values of the pressures is performed by a given dynamic periodic change of the value of connection between the working zones with a simultaneous given change of the value of the connection in its each period during the process of transporting of the object.

At the same time, the given dynamic periodic change of the value of connection of the working zones with the simultaneous given change of the value of the connection in its each period is performed by a given dynamic periodic generation in a portion of a border of separation between the working zones of a throughgoing passage (or several passages) with a simultaneous given change of the value of a given area of a minimal cross-section of the passage (or several passages) in each period of the generation, accompanied by performing correspondingly of a given dynamic periodic local destruction and subsequent construction of the portion of the border with a simultaneous given change of the value of area of its local destruction in each period during the process of transporting of the object. The above-mentioned local destruction is performed by destruction means, for example: technical, physical, chemical, physical-chemical, or is performed by a combination of several types of the destruction means. The portion of the border of separation between the working zones can be identified either structurally or spatially.

In some cases of utilization of the new method, in a process of the given dynamic periodic generation on a portion of the border of separation between the working zones of the throughgoing passage (or several passages) with simultaneous given change of the value of the given area of a minimal throughgoing cross-section of the passage (or several passages) in each period of its action, a filtration of local volume of the carrying medium in a zone of the given throughgoing passage during the process of the transporting of the object is performed.

The above-mentioned new features of said invention reflect a new "Principle of controlled interior dynamic shunting" of working zones of the pressure drop means. In accordance with the important features of said invention, in said method for performing the given modulation of the value of the action in the action means, values of its parameters are given: frequency, range and law of dynamic periodic change of the value of the action during the process of transporting of the object. The method makes possible a realization of one of several main variants of given values of the parameters:

- given values of parameters of modulation do not change during the process of transporting;
- values of one (or several) of the given parameters of the modulation is (or are) changed in a given dependency from changes of a controlled characteristic connected with the process of transporting of the object;
- values of changing parameters of the given modulation are changed in a given dependency from changes of a combination of several types of the controlled characteristics connected with the process of transporting of the object.

The process provides a possibility to use as the control characteristic, without any limitation, for example the following:

- value of one of the parameters of the process of transporting of the object (energy consumption, optimized specific consumption energy or speed parameter);
- values of one of the parameters of the transporting object (speed, consumption, aerodynamic, hydrodynamic, structural, physical, amplitude-frequency, chemical or geometric parameter);
- values of one of the parameters of spatial position of the object during the process of transporting;
- values of one of the parameters of a surface of a position of the object during the process of transporting (for example physical-mechanical);
- values of one of the parameters of the flow of the carrying medium during the process of transporting of the object (for example speed, structural, physical or chemical parameter);
- values of one of the parameters of a turbulent process in the flow of carrying medium during the process of transporting of the object (for example amplitude, frequency or energy parameter);
- value of one of the parameters of a process of conversion of energy of movement of the flow of carrying medium into another type of energy (during interaction or without interaction with an additional source of energy which acts on the flow) during the process of transporting of the object.

A functional classification of the methods of minimization of hydrodynamic resistance of turbulent medium flow, proposed for the first time in 100 years, allowed the authors to divide these methods into four groups. The analysis of methods of minimization of hydrodynamic resistance was made taking into consideration the particulars of the types of actions on the turbulent flow structure and turbulent boundary layer.

The first group includes methods of mechanical constructive-parametric perturbations of medium flow. Said methods use the changes of interior surface of the pipe, for example:

method of mechanical constructive-geometric perturbations of medium flow, with turbulators installed on the interior surface of the pipe for local perturbations of turbulent boundary layer—Germany, 1904;

method of mechanical constructive-surface perturbations of medium flow, with a polymer coating installed on the interior surface of the pipe for diminution of friction tension USA, 1916.

General shortcomings of the indicated first group of methods include: perturbations action on the local part of the flow; impossibility of automatic control of action on the process for changing technological parameters of medium flow; limited applied possibilities from the constructive point of view; costliness of technical realization; possibility of chemical reactions between the polymer coating and different flow media etc.

The second group includes methods of rheological changing of the medium flow. Said methods use injection of additional liquid polymers in the medium flow, for example:

method of local polymer-dosing of rheological changing of the medium flow (for example, a small quantity of liquid polymers with long and heavy molecules injected in a flow for diminution of medium flow viscosity—Netherlands, 1948).

General shortcomings of the indicated second group of methods are following: changes of chemical composition of flow medium can be used only for limited types of flows, which allow pollution, and etc.

The third group includes methods of mechanical local periodical perturbations of medium flow. Said methods use different types of local periodical perturbations energy action of the medium flow, for example:

method of mechanical local-streamwise periodical perturbations of medium flow, such as small local perturbations provided by a wall canal or a pipe portion effectuating periodical streamwise oscillations—England, 1963;

method of mechanical local-spanwise periodical perturbations of medium flow, such as small local perturbations provided by a canal element or a pipe around its axis effectuating periodical spanwise oscillations—England, 1986;

method of mechanical local rotational periodical perturbations of medium flow, such as small local rotational perturbations provided by rotation of a pipe around its axis—USA, 1988;

method of mechanical local radial periodical perturbations of medium flow, such as small local perturbations provided by a mechanical radial periodical pressure propagating along a whole cross section of the pipe—Denmark, 1997.

General shortcomings of the indicated third group of methods are the following: small local perturbations; consumption of additional energy; constructive complications of practical realization; limited area of applications, etc.

As has been shown by the multi-years research by the authors (in company "Remco International, Inc.", PA, USA) the above-mentioned fundamentally new (the fourth group) methods of dynamic transporting of an object with a flow of a carrying medium (USA, 1990 and 2004) do not have practical analogs in the history of development of hydrodynamics in regard to real possibilities of decreasing of hydrodynamic resistance of turbulent flows. Said dynamic energy-saving methods, based on a complex of fourteen analyzed basic constructional, energy, operational and economic criteria far exceed the efficiency of all above-mentioned researched methods of decreasing of hydrodynamic resistance of the turbulent medium flows. A wide efficient practical application of the new modulation methods will open qualitatively new real possibilities of decreasing, by tens of percents, of hydrodynamic resistance of turbulent flows.

Therefore, a future search of scientifically justified ways of the energy optimization of said dynamic energy-saving methods is foremost for accelerated practical development of modulating of aero- and hydrodynamic processes of superconductive transporting of objects with a flow of a carrying medium.

SUMMARY OF THE INVENTION

Accordingly, it is an object of the present invention to provide a new method of dynamic energy-saving superconductive transporting of medium flow, which is based on new modulation principles.

The proposed method is based on the results of multi-years scientific research of Dr. A. Relin and Dr. I. Marta, developing the concepts of the above-mentioned new theory "Modulating aero- and hydrodynamics of processes of transporting objects with a flow of a carrying medium". Said scientific research had following goals, connected with solutions of series of fundamentally new scientific-practical problems:

establishment of a scientifically-founded law of negative modulating, providing maximum energy efficiency of process of introduction in the flow of modulated medium flow-forming action and correlation, connecting other general predetermined modulation parameters (a frequency and a range);

establishment of a scientifically-founded range for a choice of a frequency of said negative modulating, providing maximum energy efficiency of a wave process of introduction of modulated medium flow-forming action in the flow;

establishment of a scientifically-founded criterion of energy optimization of said negative modulating of a value of medium flow-forming action to realize said new method of dynamic energy-saving superconductive transporting of medium flow;

establishment of a scientifically-founded new additional time parameter of said negative modulating, providing maximum energy efficiency of process of introduction of modulated medium flow-forming action in the flow, when said modulated medium flow interacts with at least one independent predetermined periodic process;

establishment of a scientifically-founded zone for realization of a dynamic efficient wave process of dynamic connection with technical realization of the above-mentioned "Principle of controlled interior dynamic shunting" of suction and power working zones of the means of medium flow-forming action or the above-mentioned "Principle of controlled exterior dynamic shunting".

For the first time this scientific research allows the authors to propose new most energy-effective principles of realization of said negative modulating of a value of a medium flow-forming action for realizing of said new method of dynamic energy-saving superconductive transporting of medium flow.

In keeping up with these objects and with others, which will become apparent hereinafter, one of the new features of the present invention resides, briefly stated, in a new method of dynamic energy-saving superconductive transporting of medium flow, which includes the following.

In a dynamic medium flow controlled transporting system for providing a dynamic medium flow process, comprising at least one action means of medium flow-forming action, a method of energy optimizing comprising the steps of:

negatively modulating a value of said medium flow-forming action includes providing a frequency, a range and a law as general predetermined modulation parameters;

a value of said predetermined frequency is changed to provide plane waves of a modulated medium flow-forming action propagating along a longitudinal axis of said modulated medium flow;

said modulating includes providing a comparative phase as an additional predetermined modulation parameter, when said modulated medium flow interacts with at least one independent predetermined periodic process; and providing a minimal value of an energy ratio of controlled acting value of said modulated medium flow-forming energy to a controlled acting value of a formed kinetic energy of said modulated medium flow during said dynamic medium flow process by changing a value of at least one modulation parameter in dependence on a change of a value of at least one characteristic connected with said dynamic medium flow process for dynamic structural energy optimization, in an energy-effective manner, in said dynamic medium flow process.

As the above-mentioned action means of medium flow-forming action, either a means of pressure drop or a means of direct energy action can be utilized. The proposed method embraces all possible spatial conditions of the flow-transporting object. In some cases the object can be a flowable medium and in this case it can perform a function of a carrying medium. In other cases the object can be structurally not connected or structurally connected with the action means in the process of its flow-transporting. In certain situations the structural part of the object can perform the function of a converting element of the action means so as to provide the process of conversion of energy supplied to it and generated during a forced interaction of this structural part of the object with the flowable medium.

Another important feature of the present invention is that the above-mentioned predetermined law of said negative modulating of a value of said medium flow-forming action is selected in a "drop-shaped" form.

The above-mentioned predetermined "drop-shaped" form of said law of said negative modulating (which is named by authors—"drop-shaped modulating law of Relin—Marta") includes providing a decrease of a value of said medium flow-forming action from a current maximal value by a predetermined value of a range of said modulating during a predetermined front time of realization of a predetermined front short part of said "drop-shaped" form of said law, and providing recovery of a value of said medium flow-forming action to said current maximal value of said action during a predetermined back time of realizing a predetermined extended back part of said "drop-shaped" form of said law during each predetermined period of said modulating, which is changed to provide a predetermined period and frequency of said modulating.

At the same time the predetermined front short part of the "drop-shaped" form of said modulation law is changed along a predetermined curve form of a quarter of an ellipse. The horizontal axis of said ellipse coincides with the horizontal axis of said "drop-shaped" form of said modulation law. The predetermined extended back part of the "drop-shaped" form of said modulation law is changed along a predetermined curve form of a degree function such that an initial value of said curve of the degree function coincides with an ending value of said curve of a quarter of an ellipse.

The above-mentioned predetermined "drop-shaped" form of said law of said negative modulating includes providing a predetermined value of a time ratio of said predetermined front time to said predetermined period of negative modulating. The value of said predetermined time ratio is selected from the range: more than 0 and less than 0.5. The value of the time ratio is an additional predetermined modulation parameter of said negative modulating. It can be changed in dependence on a change of a value of at least one characteristic connected with said dynamic medium flow process to provide a minimal value of the energy ratio of a controlled acting value of said modulated medium flow-forming energy to a controlled acting value of a formed kinetic energy of said modulated medium flow during said dynamic medium flow process for dynamic structural energy optimization, in an energy-effective manner, in said process.

Changes of said value of the time ratio can include:

changing a predetermined front time and providing a predetermined period of said negative modulating simultaneously;

changing a predetermined period of said negative modulating and providing a predetermined front time simultaneously;

changing a predetermined front time and a predetermined period of said negative modulating simultaneously.

In accordance with another feature of the present invention, the modulated medium flow includes providing a predetermined comparative phase of negative modulating which is changed to provide a phase shift to a comparative phase of said independent predetermined periodic process. At the same time the independent predetermined periodic process includes providing a frequency, a range, a law and a comparative phase of predetermined periodic parametric changes.

The above-mentioned independent predetermined periodic process can include, without any limitation, for example:

providing a modulating of a value of a medium flow-forming action of at least one additional means of medium flow-forming action directly connected with said modulated medium flow;

providing a modulating of a value of a medium flow-forming action of at least one additional means of medium flow-forming action connected with said modulated medium flow through at least one medium flow action working zone including at least one medium flow action object.

The above-mentioned medium flow action working zones can include at least one perforated inlet to provide perforated medium flows, and the above-mentioned medium flow action objects can be, without any limitation, for example:

an object with a porous structure;

an object with a filter structure;

an object with a saturated porous medium;

an object with a constructive structure;

an object with specific detection.

In accordance with another feature of the present invention, said independent predetermined periodic process can include, without any limitation, for example:

providing a predetermined periodic injection of said modulated medium flow inside at least one working zone;

providing a predetermined periodic injection of said modulated medium flow inside at least one working zone for realization of a technological process in said working zone including at least one medium flow action object;

providing a predetermined periodic energy action on said modulated medium flow injected inside at least one working zone for realization of a process of energy converting of said modulated medium flow in said working zone (for example: an injected modulated medium flow burning zone, or an injected modulated fuel flow burning zone into a combustion chamber of internal combustion engine).

The above-mentioned independent predetermined periodic process can include providing a modulating of a value of a medium flow-forming action of at least one additional action means of medium flow-forming action connected with an additional modulated medium flow, which is constructively separated from said general modulated medium flow. At the same time the constructively separated additional modulated medium flow and said general modulated medium flow are predetermined simultaneously, to provide, without any limitation, for example:

heat-transferring process in a "double-canal" heat exchanger including interior and exterior heat transfers;

movement of at least one object constructively connected with said modulated medium flows.

Said independent predetermined periodic process can include providing a modulating of a value of a medium flow-forming action of at least one additional action means of medium flow-forming action connected with an additional modulated medium flow, which constructively directly is not connected with said modulated medium flow.

In accordance with another feature of the present invention, said providing minimal value of the energy ratio, which is named by authors—"Modulated medium flow energy optimizing criterion of Relin—Marta", provides a minimal value (approaching one) for keeping up a superconductive energy mode of said modulated medium flow transporting (superconductive flow).

At the same time the controlled acting value of said modulated medium flow-forming energy can be evaluated with the use of, for example: a controlled acting value of a modulated medium flow pressure, provided by said action means of medium flow-forming action, or a controlled acting value of at least one energy parameter, connected with a value of energy consumption of said action means of medium flow-forming action.

The above-mentioned controlled acting value of said formed kinetic energy of said modulated medium flow can be evaluated with the use of, for example: a controlled acting value of a modulated medium flow velocity and a predetermined value of a flow medium density, or a controlled acting value of a modulated medium flow velocity and a controlled acting value of a flow medium density.

A new method makes possible a realization of one of several main variants of said negative modulating of a value of the medium flow-forming energy that includes providing, for example:

an interior modulating process, which realizes the principle of controlled interior dynamic shunting of suction and power working zones of said action means of medium flow-forming action, as disclosed for example in U.S. Pat. No. 6,827,528 (2004)—A. Relin; an exterior modulating process, which realizes the principle of controlled exterior dynamic shunting of a selected portion of a modulated suction medium flow, connected with a suction working zone of said action means of medium flow-forming action, as disclosed for example in U.S. Pat. No. 5,593,252 (1997)—A. Relin, et al;

an interior modulating process, which realizes the principle of controlled interior dynamic shunting of suction and power working zones of said action means of medium flow-forming action, and an exterior modulating process, which realizes the principle of controlled exterior dynamic shunting of a selected portion of a modulated suction medium flow, connected with a suction working zone of said action means of medium flow-forming action, simultaneously;

a controlled predetermined dynamic periodic change of a value of at least one parameter, dynamically connected with a process of a conversion of a consumption energy into said modulated medium flow-forming action realizable in said action means of medium flow-forming action, as disclosed for example in U.S. Pat. No. 6,827,528 (2004)—A. Relin.

In accordance with another feature of the present invention, said dynamic shunting includes providing a controlled predetermined periodic connection of said modulated suction flow with a modulated shunt medium flow, which is realized around of said suction flow. At the same time the above-mentioned negative modulating comprises a modulation discrete input and an optimization parametric input.

In some cases utilization of the new method of energy optimizing makes possible a realization providing a maximal value of energy efficiency of said dynamic medium flow process by changing a value of at least one modulation parameter in dependence on a change of a value of at least one characteristic connected with said dynamic medium flow process for dynamic structural energy optimization, in an energy-effective manner, in said dynamic medium flow process. The energy optimizing can provide a possibility to use different characteristics connected with said dynamic medium flow process, for example, without any limitation, as disclosed in U.S. Pat. No. 6,827,528.

The novel features which are considered as characteristics for the present invention are set forth in particular in the appended claims. The invention itself, however, both as to its construction and new method of operation, together with additional objects and advantages thereof, will be best understood from the following description of specific embodiments when read in connection with the accompanying drawings.

DESCRIPTION OF THE PREFERRED EMBODIMENTS

A proposed new method of dynamic energy-saving superconductive transporting of medium flow can be realized in the following manner.

Figure 1:
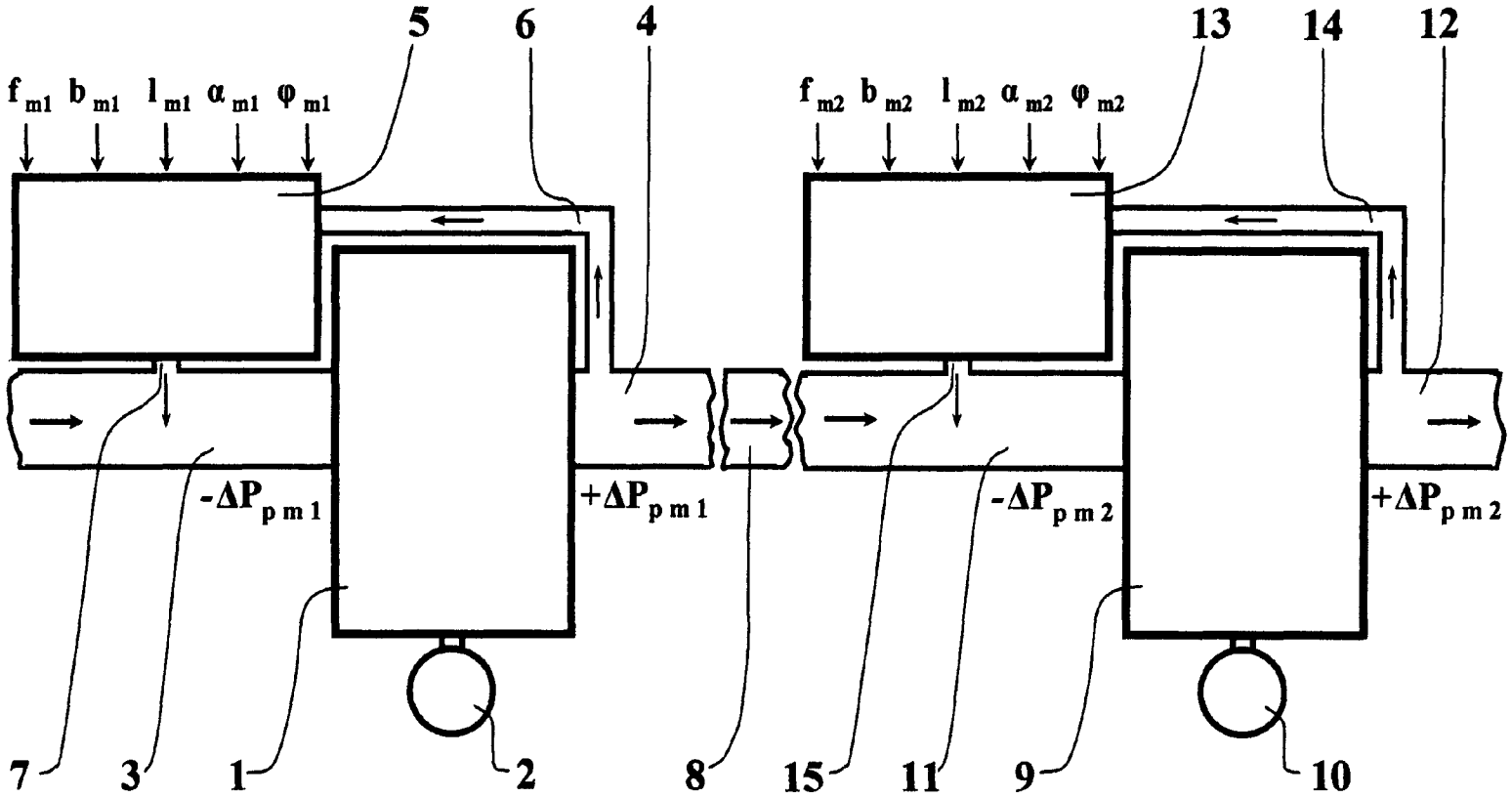
FIG. 1 is a view showing one of possible variants of a scheme of a functional structure of a dynamic transporting system comprising two identical dynamic subsystems. They includes an action means of medium flow-forming action (for example a pump) and an energy-saving dynamic module (connected with the means), each for providing a dynamic medium flow pipeline transporting process, which realizes a new method of dynamic energy-saving superconductive transporting of medium flow in accordance with the present invention.

One of possible variants of a scheme of a functional structure of a dynamic transporting system comprising two identical dynamic subsystems, includes an action means of medium flow-forming action (pump) and an energy-saving dynamic module (connected with the means), each for providing a dynamic medium flow pipeline transporting process shown in FIG. 1. First dynamic subsystem includes a pump 1 representing a cyclic drive means for transporting medium (for example,—oil) flow through an enclosed passage and having a first working zone in a negative drive cycle (in which negative overpressure $-\Delta P_{p1}$ is generated) and a second working zone in a positive drive cycle (in which positive overpressure $+\Delta P_{p1}$ is generated). It has a drive 2 for the pump 1, a suction part of a pipeline 3 and a power part of a pipeline 4, an energy-saving dynamic module (which is named by authors—ESDM) 5 connected with the power part of pipeline 4 and the suction part of pipeline 3 correspondingly through a long inlet portion of a module shunt canal 6 and a short outlet portion of a module shunt canal 7. An extended part of pipeline 8 connects the first dynamic subsystem with identical second dynamic subsystem, that includes a pump 9 representing a cyclic drive means for transporting a medium (oil) flow through an enclosed passage and having a first working zone in a negative drive cycle (in which negative overpressure $-\Delta P_{p2}$ is generated) and a second working zone in a positive drive cycle (in which positive overpressure $+\Delta P_{p2}$ is generated). It has further a drive 10 for the pump 9, a suction part of a pipeline 11 and a power part of a pipeline 12, an energy-saving dynamic module 13 connected with the power part of pipeline 12 and the suction part of pipeline 11 correspondingly through a long inlet portion of a module shunt canal 14 and a short outlet portion of a module shunt canal 15.

Figure 2:
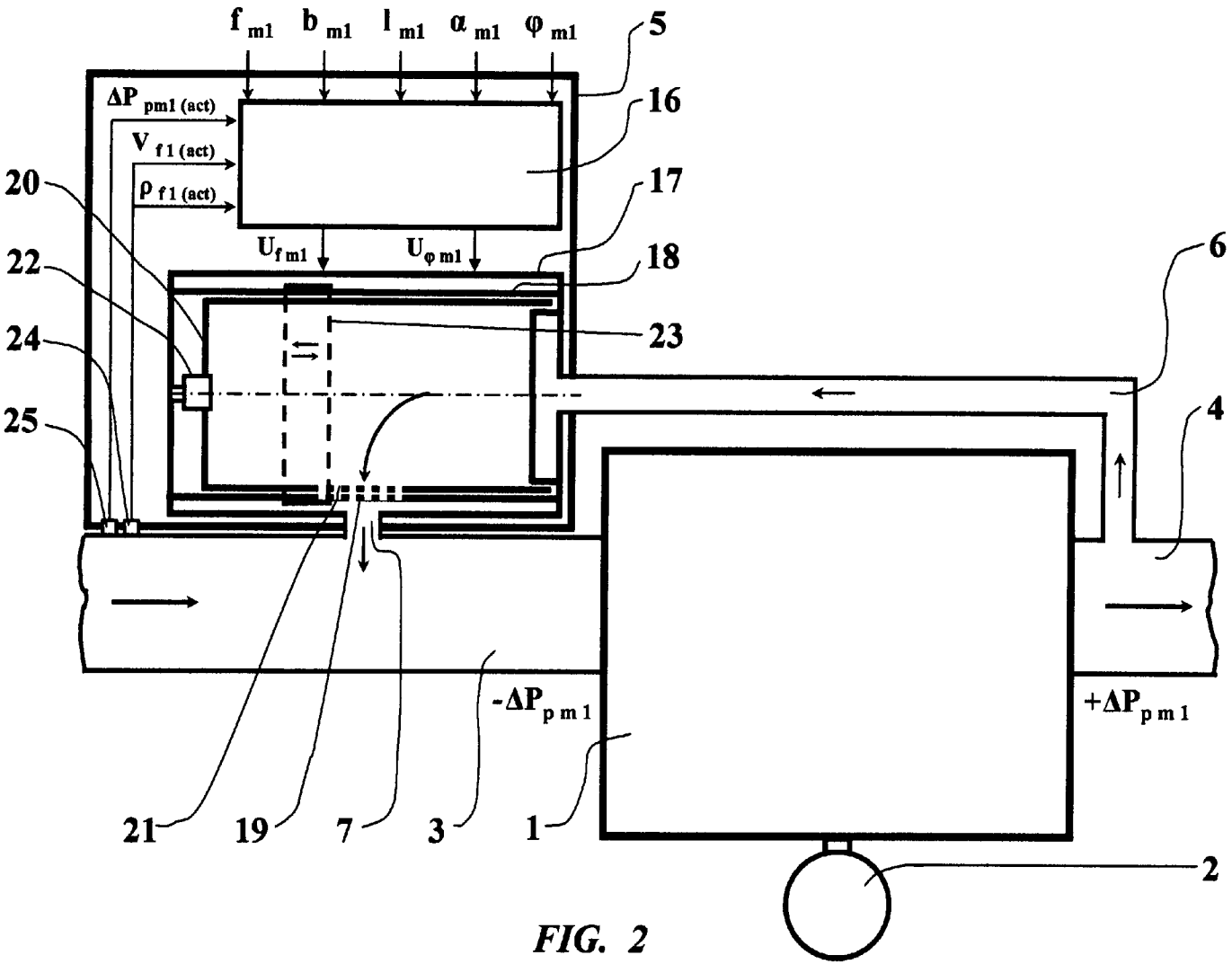
FIG. 2 is a view showing one of possible variants of a scheme of a functional structure of an energy-saving dynamic module connected with a pump in a dynamic subsystem, which realizes a new method of dynamic energy-saving superconductive transporting of medium flow in accordance with the present invention.

One of possible variants of a scheme of a functional structure of the energy-saving dynamic module 5 connected with the pump 1 in the first dynamic subsystem, which realizes the new method of dynamic energy-saving superconductive transporting of medium flow, in accordance with the present invention is shown in FIG. 2. The dynamic module 5, which realizes the "Principle of controlled inner dynamic shunting" of working zones of the pump 1, functionally includes a microprocessor control block 16, a body of a valve block 17 whose inner cavity is connected correspondingly by an inlet to a long inlet portion of the module shunt canal 6 and by an output—with a short outlet portion of the module shunt canal 7, an immovable cylindrical valve element 18 having a through canal 19, a movable cylindrical valve element 20 having a through canal 21, a drive 22 of the movable cylindrical valve element 20, a control element (for example, ring) 23, a sensor 24 which controls an acting value of a pipeline medium flow velocity $V_{f1(act)}$ and an acting value of a pipeline medium flow density $\rho_{f1(act)}$ and a sensor 25 which controls an acting value of a modulated pipeline medium flow pressure $\Delta P_{pm1(act)}$.

The sensor 24 which controls an acting value of a pipeline medium flow velocity $V_{f1(act)}$ and an acting value of a pipeline medium flow density $\rho_{f1(act)}$, for example, can be a two canal half-ring high-frequency capacitor sensor realized with the use of the "SCP measurement technology" (U.S. Pat. No. 5,502,658 (1996)—A. Relin, "Sampled-Continuous Probability Method of Velocity Measurement of the Object Having Informatively-Structural Inhomogeneity" or the book "The Systems of Automatic Monitoring of Technological Parameters of Suction Dredger"—A. Relin, Moscow, 1985). The microprocessor control block 16 has three optimization parametric inputs connected with two outputs of the sensor 24 (signal $V_{f1(act)}$ and signal $\rho_{f1(act)}$) and output of the sensor 25 (signal $\Delta P_{pm1(act)}$), five modulation discrete inputs for setting of a predetermined modulation parameters (a frequency $f_{m1}$, a range $b_{m1}$, a law $l_{m1}$, a comparative phase $\phi_{m1}$ of the negative modulating a value of the medium flow-forming action of the pump 1 and the time ratio $\alpha_{m1}$ of the "drop-shaped" form of the law $l_{m1}$) and two controlling outputs (signal $U_{fm1}$ and signal $U_{\phi m1}$) connected with the drive 22 of the movable cylindrical valve element 20.

Taken together, the combined immovable cylindrical valve element 18 with the through canal 19, the concentric movable cylindrical valve element 20 with the through canal 21, the drive 22 of the valve element 20, control element 23 and a body of a valve block 17 provide one of several possible variants of a scheme of a functional structure of a cylindrical valve block of the energy-saving dynamic module 5. This dynamic module realizes the new predetermined "drop-shaped" form of a law $l_{m1}$ of dynamic periodic change of a value of interior modulating connection $C_{m1}$ between the working zones of the pump 1. With this, a cut off of the through canal 19 has the predetermined "drop-shaped" form (half of a "drop") with predetermined sizes. The elongated longitudinal axis of the cut off consists of a line of cross-section of a circle of the immovable cylindrical valve element 18. A cut off of the through canal 21 has a predetermined linear rectangular form with predetermined sizes. The elongated longitudinal axis of the cut off is parallel to longitudinal axis of the movable cylindrical valve element 20. The control element (ring) 23 can have a width with various shapes and can be used for providing (setting or correcting) initial area and shape of a cross-section of the through canal, which is formed by the through canals 19 and 21 during the process of rotation of the movable cylindrical valve element 20 relative to the immovable cylindrical valve element 18. The control element 23 has a possibility of a given linear or given angular movement relative to the through canal 19 for providing (setting or correcting) initial area and shape of the cross-section of the thusly-formed through canal. The short outlet portion of the module shunt canal 7 has a minimal length for providing a minimal distance between the cross-section of the thusly-formed through canal and the modulated suction pipeline medium flow.

A scheme of a functional structure of the dynamic module 13, which also as realizes the "Principle of controlled inner dynamic shunting" of the working zones of the pump 9, is realized completely by analogy with the scheme of the above-mentioned functional structure of the dynamic module 5. The microprocessor control block of the dynamic module 13 also has three analogous optimization parametric inputs (signal $V_{f2(act)}$ and signal $\rho_{f2(act)}$) from a sensor controlling an acting value of a pipeline medium flow velocity $V_{f2(act)}$ and an acting value of a pipeline medium (oil) flow density $\rho_{f2(act)}$ in the dynamic module 13, as well as signal $\Delta P_{pm2(act)}$ from a sensor controlling an acting value of a modulated pipeline medium flow pressure $\Delta P_{pm2(act)}$ in the dynamic module 13); five modulation discrete inputs for setting predetermined modulation parameters (a frequency $f_{m2}$, a range $b_{m2}$, a law $l_{m2}$, a comparative phase $\phi_{m2}$ of the negative modulating a value of the medium flow-forming action of the pump 9 and a time ratio $\alpha_{m2}$ of the "drop-shaped" form of the law $l_{m2}$); and two control outputs (signal $U_{fm2}$ and signal $U_{\phi m2}$) connected with the drive of the movable cylindrical valve element in the body of a modulator of the dynamic module 13. The functional elements of the dynamic module 5 and the dynamic module 13 make possible providing of optimal parameters of theirs operation, as shown in FIG. 1 and FIG. 2.

The above-described dynamic medium flow control transporting system for providing a dynamic medium flow process that realizes the new method of dynamic energy-saving superconductive transporting of medium flow in accordance with the present invention operates in the following manner.

After turning on the drive 2 of the pump 1 in the first dynamic subsystem, the pump 1 starts generating a working pressure difference $\Delta P_{p1}$ of medium (oil) flow-forming action, applied to an oil medium and generating an oil flow in the suction part of pipeline 3 and in the power part of pipeline 4 in FIGS. 1 and 2. In the described initial position of operation of the first dynamic subsystem, when the energy-saving dynamic module 5 (connected with the power part of pipeline 4 and the suction part of pipeline 3 correspondingly through a long portion of inlet of a module shunt canal 6 and a short outlet portion of a module shunt canal 7) is turned off, an area of a cross-section of the thusly-formed through canal of the valve block is equal to zero. This correspondingly determines a zero (minimal) value $C_{m1(min)}$ of the modulating connection $C_{m1}$, between the working zones of the pump 1, provided by the dynamic module 5, which realizes the above-mentioned "Principle of controlled interior dynamic shunting" of the first ($-\Delta P_{p1}$) and second ($+\Delta P_{p1}$) working zones of the pump 1. After turning on of the dynamic module 5, the drive 22 starts to rotate the movable cylindrical valve element 20. The through canals 19 and 21 start superposing with one another, which determines a dynamic change of the area of cross-section of the thusly-formed through canal of the valve block. When the area of the cross-section of the thusly-formed through canal reaches a maximal value, the maximal value $C_{m1(max)}$ of the modulating connection $C_{m1}$ of the working zones of the pump 1, by oil flow, is provided.

Figure 3:
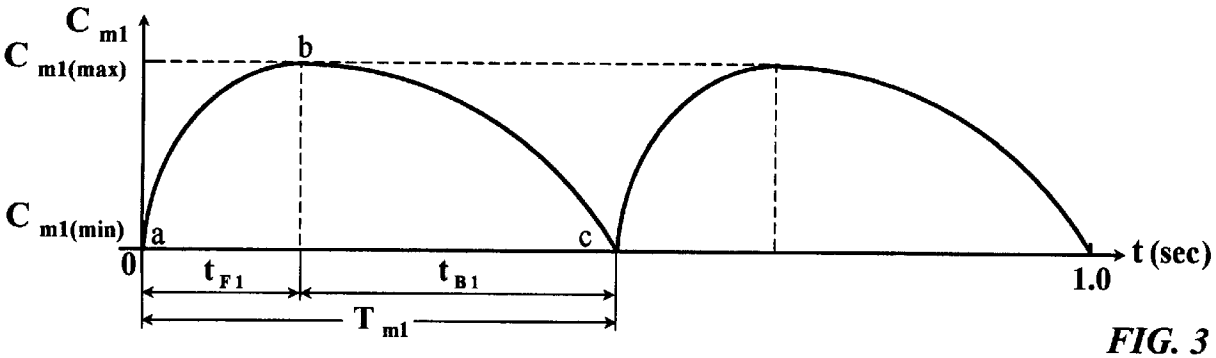
FIG. 3 is a view showing a diagram of an example of a predetermined "drop-shaped" form of a law of dynamic periodic change of a value of an interior modulating connection between working zones of the pump, provided by an energy-saving dynamic module, which realizes the principle of controlled interior dynamic shunting of a suction and power working zones of the means (pump) of medium flow-forming action.

The above-mentioned forms of cut off of the through canal 19 of the immovable cylindrical valve element 18 and through canal 21 of the movable cylindrical valve element 20 provide a realization of the predetermined law of the "drop-shaped" form of dynamic periodic change of the value of an interior modulating connection $C_{m1}$ between the working zones of the pump 1 (see FIG. 3). The predetermined periodical modulating (with a predetermined period $T_{m1}$) of the connection $C_{m1}$ is determined by a speed of rotation of the drive 22 of the movable cylindrical valve element 20. At the same time, each predetermined period $T_{m1}$ of the change of value of interior modulating connection $C_{m1}$ includes providing an increase of the value $C_{m1}$ from the minimal value (zero) $C_{m1(min)}$ to the maximal value $C_{m1(max)}$ during a predetermined front time $t_{F1}$ of realizing a predetermined front short part of said "drop-shaped" form of said law (see the diagram part "a-b"), and providing a decrease of the value $C_{m1}$ from the maximal value $C_{m1(max)}$ to the minimal value (zero) $C_{m1(min)}$ during a predetermined back time $t_{B1}$ of realizing a predetermined extended back part of said "drop-shaped" form of said law (see the diagram part "b-c"). The predetermined diagram part "a-b" is changed along the predetermined curve form of a quarter of an ellipse. The horizontal axis of said ellipse coincides with the horizontal axis of said law of the "drop-shaped" form. The predetermined diagram part "b-c" is changed along the predetermined curve form of a degree function, such that an initial value of said curve of the degree function coincides with an ending value of said curve of a quarter of an ellipse.

Figure 4:
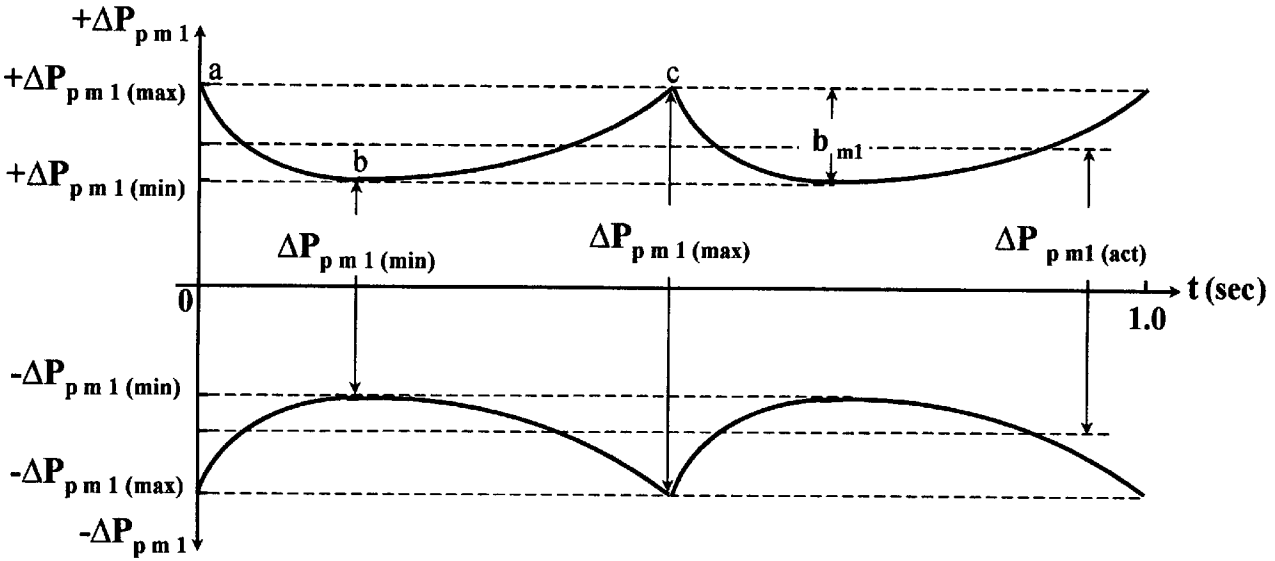
FIG. 4 is a view showing a diagram of an example of the predetermined "drop-shaped" form of a law of simultaneous dynamic periodical change (negative modulating) of a value of flow-forming positive overpressure in a power working zone and a value of flow-forming negative overpressure in a suction working zone of the means (pump) of medium flow-forming action.

In turn, the predetermined change of value of interior modulating connection $C_{m1}$ in each predetermined period $T_{m1}$ leads to a simultaneous predetermined dynamic periodic change (modulating) of the value of the modulated negative overpressure $-\Delta P_{pm1}$ and of the value of the modulated positive overpressure $+\Delta P_{pm1}$ in each period of their changes in corresponding suction and power working zones of the pump 1 (FIG. 4). The value of the modulated negative overpressure $-\Delta P_{pm1}$ is periodically changed in a predetermined range $b_{m1}$ of the negative modulating: from the $-\Delta P_{pm1(max)}$ to the $-\Delta P_{pm1(min)}$, while the value of the modulated positive overpressure $+\Delta P_{pm1}$ simultaneously periodically changes within a predetermined range $b_{m1}$ of the negative modulating: from the $+\Delta P_{pm1(max)}$ to the $+\Delta P_{pm1(min)}$. The above-mentioned maximal values of the overpressures $-\Delta P_{pm1(max)}$ and $+\Delta P_{pm1(max)}$ correspond to a moment when an area of a cross-section of the thusly-formed through canal of the valve block is equal to zero (minimal value $C_{m1(min)}$). The above-mentioned minimal values of the overpressures $-\Delta P_{pm1(min)}$ and $+\Delta P_{pm1(min)}$ correspond to a moment when an area of a cross-section of the thusly-formed through canal of the valve block is maximal (maximal value $C_{m1(max)}$). This situation occurs in each period $T_{m1}$ of the periodically repeating displacements of the movable cylindrical valve element (with the predetermined frequency of the negative modulating $f_{m1}=1/T_{m1}$).

Therefore, as a result of the above-mentioned dynamic periodic shunting interaction of the elements of the energy-saving dynamic module 5 with corresponding suction and power working zones of the pump 1, the predetermined negative modulating of the value of the pressure drop $\Delta P_{pm1}$ (oil flow-forming action) in the predetermined range $b_{m1}$ of its dynamic periodic change ($\Delta P_{pm1(max)}-\Delta P_{pm1(min)}$) is performed during the process of transporting of the medium flow. The negative modulating of the value of the pressure drop $\Delta P_{pm1}$ is performed along the law $l_{m1}$ of the "drop-shaped" form (FIG. 4), which provides:

- decrease of the value of said flow-forming action $\Delta P_{pm1}$ from a current maximal value $\Delta P_{pm1(max)}$ by a predetermined value of said range $b_{m1}$ of modulating (until $\Delta P_{pm1(min)}$) during a predetermined front time $t_{F1}$ of realizing a predetermined front short part $l_{m1(a-b)}$ (see the diagram part "a-b") of said law $l_{m1}$ of the "drop-shaped" form during each predetermined period $T_{m1}$ of said negative modulating, which is changed along the predetermined curve form of a quarter of an ellipse, so that the horizontal axis of said ellipse coincides with the horizontal axis of said "drop-shaped" form of said modulation law $l_{m1}$;
- recovery of a value of said medium flow-forming energy action $\Delta P_{pm1}$ to said current maximal value $\Delta P_{pm1(max)}$ during a predetermined back time $t_{B1}$ of realizing a predetermined extended back part $l_{m1(b-c)}$ (see the diagram part "b-c") of said "drop-shaped" form of said law $l_{m1}$ during each predetermined period $T_{m1}$ of said negative modulating, which is changed along the predetermined curve form of a degree function such that an initial value of said degree function curve coincides with an ending value of said quarter of an ellipse curve $\Delta P_{pm1(min)}$ to provide a predetermined period $T_{m1}$ of said modulating;
- predetermined value of the time ratio $\alpha_{m1}$ of said predetermined front time $t_{F1}$ in said predetermined period $T_{m1}$ of said negative modulating, which is an additional predetermined modulation parameter of said negative modulating ($\alpha_{m1}=t_{F1}/T_{m1}$) and is selected from the range: more than 0 and less than 0.5.

The above-mentioned so-called "drop-shaped modulating law of Relin—Marta" $l_{m1}$ (for above-mentioned example) is described by two expressions:

$$l_{m1(a-b)}=\Delta P_{pm1(max)}-b_{m1}*[1-(1-t/t_{F1})^2]^{1/2}, \text{ for } 0\le t\le t_{F1}; \text{ and}$$

$$l_{m1(b-c)}=(\Delta P_{pm1(max)}-b_{m1})+(t-t_{F1})^8/(T_{m1}-t_{F1})^\theta, \text{ for } t_{F1}\le t\le T_{m1}; \text{ and}$$

and where $\theta>1$ (depends on $t_{F1}$, $T_{m1}$ and $b_{m1}$).

The acting value of said modulated medium flow-forming energy is evaluated with the use of a controlled acting value of a modulated medium flow pressure $\Delta P_{pm1(act)}$. A modulating pressure $\Delta P_{pm1}$ (modulating energy action) wave is formed during rotation of the movable cylindrical valve element 20 of the valve block, by superposition of cross-section of the through canal 21 of the movable valve element 20 and cross-section of the through canal 19 of the immovable element 18 of the valve block, executing a commutation of the pressure zone $+\Delta P_{pm1}$ of the long inlet portion of shunt canal 6 with the pressure zone $-\Delta P_{pm1}$ of the short outlet portion of shunt canal 7 of the energy-saving dynamic module 5. The formed modulating wave of pressure $\Delta P_{pm1}$ is propagated through short outlet portion of the shunt canal 7 in the suction part of pipeline 3 and further in the power part of pipeline 4 along the longitudinal axis of the medium flow. The short outlet portion of the module shunt canal 7 provides the minimal distance between the cross-section of the thusly-formed through canal and the modulated suction pipeline medium flow. Due to significant reduction of the time of "running" of a commutation pressure wave in the shunting canal the "drop-shaped" form of said modulation law $l_{m1}$ with minimal distortion, is provided. The propagation of modulating pressure waves in the flow pipeline is fulfilled in the form of plane waves, which realize a maximum energy wave action on turbulence and on the boundary layer of medium flow in the pipeline. The predetermined frequency $f_{m1}$ of said modulating energy action $\Delta P_{pm1}$ is changed to provide the modulated longitudinal waves in the pipeline, considering that the velocity of propagation of plane waves in the pipeline medium (oil) flow $C_{fm}$ and the pipeline diameter $d_p$ are connected by relation: $f_{m1}<<0.3\cdot C_{fm}/d_p$.

The authors' research with the use of the experimental results confirmed, that the proposed optimal "drop-shaped" form of modulating law $l_{m1(opt)}$ is the most energy efficient form (in comparison with other known forms of a modulating law, for example: sinusoidal, rectangular, triangular, trapezoidal etc.) to bring in a medium flow the modulated medium flow-forming energy. Additionally, the optimal "drop-shaped" modulating law $l_{m1(opt)}$ (that takes into consideration its given natural form) efficiently joins all basic predetermined modulation parameters of said negative modulating of a medium flow-forming energy between them. It is the basis of a first created mathematical modulation-hydrodynamic model for computer search of optimal modulation parameters: $f_{m1(opt)}$ $b_{m1(opt)}$, $\alpha_{m1(opt)}$. The above-mentioned so-called "modulation hydrodynamic model of Relin—Marta" created with the use of unique experimental information and so-called "modulated medium flow energy optimizing criterion of Relin—Marta" $E_{Rm1}$ (for above-mentioned example) is described by the expression:

$$E_{Rm1}=E_{ffm1(act)}/E_{km1(act)}=\Delta P_{pm1(act)}/(\rho_{f1(act)}*V^2_{f1(act)}/2), \text{ where}$$

$E_{ffm1(act)}$—a controlled acting value of dynamic flow-forming action, $E_{km1(act)}$—a controlled acting value of kinetic energy of the medium flow, $\Delta P_{pm1(act)}$—a controlled acting value of modulated medium flow pressure, $\rho_{f1(act)}$—a controlled acting value of a pipeline medium (oil) flow density and $V_{f1(act)}$—a controlled acting value of a pipeline medium (oil) flow velocity.

In accordance with another feature of the present invention, providing a minimal value of said energy ratio (energy optimizing criterion $E_R$) provides a minimal value (up to one) to keep up a superconductive energy mode of said transporting of modulated medium flow (superconductive flow). The values of the above-mentioned optimal modulation parameters: $f_{m1(opt)}$, $b_{m1(opt)}$, $\alpha_{m1(opt)}$ (with the use of the "drop-shaped" modulating law $l_{m1(opt)}$) corresponding to the estimated minimal value of energy optimizing criterion $E_{Rm1(min)}$ provide said superconductive energy mode. It is determined from the functional dependence of $E_{Rm1}$ that can be obtained, for example, on the basis of computer modeling with the use of the above-mentioned "drop-shaped" modulating hydrodynamic model and Pi theorem of dimensional analysis. It determines a correlation of the criterion $E_{Rm1}$ with modulation and Reynolds criterion, depending on a value of the modulation parameters and the parameters of medium flow in a pipeline system: a maximal pump energy action $\Delta P_{pm1(max)}$, a pipeline length $L_p$, a pipeline diameter $d_p$, a controlled acting value of a pipeline medium (oil) flow velocity $V_{f1(act)}$, a controlled acting value of a pipeline medium (oil) flow density $\rho_{f1(act)}$, a medium flow dynamic viscosity $\mu_{f1}$, and also—a medium flow dynamic "modulating viscosity" $\mu_{fm1}$. Said complex of parameters reflects possible dynamic structural, rheological and temperature changes in single-phase as well as in multiphase homogeneous and heterogeneous fluid medium flows. The temperature changes of single-phase flow predetermine the changes of a pipeline medium flow density $\rho_{f1(act)}$, a medium flow dynamic viscosity $\mu_{f1}$ and dynamic "modulating viscosity" $\mu_{fm1}$. In the multiphase flow a magnitude $\mu_{fm1}$ reflects its average viscosity, which depends on a volume concentration of each phase and its dynamic distribution in a pipeline cross-section. It also takes into consideration the orientations of multi-particle clusters (for example, in disperse mixtures) of different forms (chains, triangles, hexagons etc.) relative to average flow velocity. For example, a longitudinal intensification of particles movements with sign-alternating acceleration leads to decrease of the interphase friction force. This leads to increase of said value of kinetic energy of the heterogeneous multiphase medium flow. Thus, the consideration of said complex of parameters is very important for a complete description and energy optimization of dynamic processes of pipeline transporting of medium flow of the heterogeneous and multiphase flows in power-consuming fields: in powder, oil and natural gas pipeline transporting technologies; in technologies of the hydro-transporting of sand, coal and other minerals ores, etc.

The above-mentioned scheme of a functional structure of the energy-saving dynamic module 5 (see FIGS. 1 and 2) provides the computer estimation of optimal modulation parameters: $f_{m1}=f_{m1(opt)}$, $b_{m1}=b_{m1(opt)}$, $l_{m1}=l_{m1(opt)}$ and $\alpha_{m1}=\alpha_{m1(opt)}$ in the microprocessor control block 16 and also—in the functional elements of the valve block. The optimal modulation parameters: $l_{m1(opt)}$, $b_{m1(opt)}$, and $\alpha_{m1(opt)}$ are constructively used in the cut off of the through canal 19 having the predetermined "drop-shaped" form. The estimated value of optimal modulation parameter $f_{m1(opt)}$, realizable by the predetermined estimated value of the rotation velocity of the drive 22 of the movable cylindrical valve element 20, is initially exercised by the control outputs of the microprocessor control block 16 (signal $U_{fm1}$ connected with the drive 22) to provide the estimated minimal value of energy optimizing criterion $E_{Rm1(min)}$, significantly differing from the practicable value of $E_{Rm1(max)}$ (see FIG. 5). The above-mentioned sensor 24 and sensor 25 provide control of the values of technological parameters $V_{f1(act)}$, $\rho_{f1(act)}$ and $\Delta P_{pm1(act)}$, coming in the microprocessor control block 16 for calculation of an initial real value of energy optimizing criterion $E_{Rm1(min)}$. The microprocessor-controlled optimization retrieval of a minimal practicable value of $E_{Rm1(min)cor}$ (when the derivative $dE_{Rm1(min)}/dt=0$) provides the change (to $\Delta f_{m1(opt)}$) of the estimated value of optimal modulation parameter $f_{m1(opt)}$ to the correction value $f_{m1(opt)cor}$, by changing the signal $U_{fm1}$ (to $U_{fm1cor}$) connected with the drive 22 and changing its rotation velocity.

From the definition of expression for $E_{Rm1}$ follows that it achieves the minimal value $E_{Rm1(min)cor}$ only when the controlled acting value of dynamic flow-forming action $E_{ffm1(act)}=\Delta P_{pm1(act)}$ achieves the minimal value (for $f_{m1(opt)cor}$) at the particular values of the technological parameters $V_{f1(act)}$ and $\rho_{f1(act)}$. The minimal value of controlled acting value of modulated medium flow pressure $\Delta P_{pm1(act)}$ is a quantity of energy, which is necessary to effectuate a work against turbulent friction stress in a nucleus of medium flow and in its boundary layer to maintain the controlled acting value of kinetic energy of the medium flow $E_{km1(act)}=\rho_{f1(act)}*V_{f1(act)}^2/2$, which achieves the maximal value. The value of $\Delta P_{pm1(act)}$ significantly depends of the turbulence structure and state of the boundary layer of modulated medium flow. Thus, physical meaning of the magnitude $\Delta P_{pm1(act)}$ is analogous to pressure losses in the pipeline with length $L_p$ and diameter $d_p$, at the controlled acting value of a pipeline medium (oil) flow velocity $V_{f1(act)}$, the controlled acting value of a pipeline medium (oil) flow density $\rho_{f1(act)}$, the medium flow dynamic, viscosity $\mu_{f1}$, and also—the medium flow dynamic "modulating viscosity" $\beta_{fm1}$. The minimal value of controlled acting value of modulated medium flow pressure $\Delta P_{pm1(act)}$ characterizes the minimal value of hydrodynamic resistance of modulated medium flow, which is obtained at the above-mentioned minimal value $E_{Rm1(min)cor}$ by the microprocessor-controlled optimization retrieval (the physical phenomena—"superconductive" modulated medium flow, as it was first named by Dr. A. Relin, USA in PCT/US2004/039818, 2004).

The experimental and theoretical research and also the computer simulation of the process of energy optimizing of modulating of energy of plane waves of pressure (performed by authors) confirmed that the oil flow longitudinal plane waves of the "drop-shaped" form of modulated flow-forming action $\Delta P_{pm1}$ in the pipeline are propagated (with velocity about one mile per second) along the whole oil flow for tens of miles. The interaction between these waves and flow causes the fundamentally new significant volume changes of the turbulent structure and boundary layer along the whole pipeline flow and also—a substantial modification of the overall turbulent kinetic energy.

The physical basis for choice of the "drop-shaped" form of flow-forming energy modulation law $l_{m1}$ is based on the possibility of providing the needed dynamic changes of turbulence and boundary layer of the modulated medium flow, which occur during the predetermined period $T_{m1}$. During the predetermined back time $t_{B1}$ the large-scale particles and their velocities of movement are redirected longitudinally to the average flow velocity. A probability of the formation of larger medium particles with longitudinal velocity of their movement is increased. Turbulent velocity pulsations of small-scale medium particles are also redirected along the average flow velocity. A stage $t_{B1}$ of increase of wave pressure is accompanied by the attenuation of small-scale particles generated on the boundary layer surface. The flow turbulence suffers significant changes and becomes longitudinally anisotropic. Therefore, the thickness of the boundary layer is decreased. From its surface, negative vortexes are generated. During a predetermined front time $t_{F1}$ a pressure is decreased quicker than its increase during a predetermined back time $t_{B1}$. A particles relaxation of the flow turbulence occurs differently. The small-scale and quick-acting medium particles aspire to follow the pressure changes faster, than large-scale particles. Thus the intensity of small-scale turbulence is slightly increased. At the same time, the large-scale particles are more inert and during the front time $t_{F1}$ their movements are only slightly disorientated. They maintain their hydrodynamic stability, but the forbidden states arise for their enlargement. The thickness of boundary layer is slightly increased.

At the same time, the propagation of modulated pressure waves along a pipeline medium flow is accompanied by dynamic elastic local oscillations of boundary layer. The frequency and amplitude of said elastic oscillations depend on the modulation wave parameters: $f_{m1}$, $b_{m1}$, $l_{m1}$ and $\alpha_{m1}$; density $\rho_{f1(act)}$ and compressibility $\beta_{m1}$ of medium flow. From the above-mentioned physical picture it follows that such "drop-shaped" form of modulation law $l_{m1}$ of flow-forming action allows the maintenance on average (during the period $T_{m1}$) the dynamic state of turbulence with significantly longitudinally anisotropic and lesser value of the thickness of the boundary layer. To this dynamic state corresponds a less turbulent intensity in the medium flow (and also—turbulent viscosity), which predetermines a decrease of the medium flow energy dissipation. The above-mentioned requires that the front time $t_{F1}$ of the "drop-shaped" form of flow-forming energy modulation law $l_{m1}$ must be less than the back time $t_{B1}$. Said condition predetermines a possibility of the selection of the time ratio $\alpha_{m1}=t_{F1}/T_{m1}$ (from the above-mentioned range: more than 0 and less than 0.5), considering the modulation, technological and system parameters of the dynamic medium flow transporting system. By giving the front time $t_{F1}$ and the back time $t_{B1}$ of modulated pressure wave of the "drop-shaped" form, one can provide practically constant velocity profile in the nucleus of pipeline medium flow. This establishes favorable conditions to form in the modulated flow a stable periodical toroidal vortex structures and other stable periodical ordered vortex formations (for example, a cell structure), which are moving sufficiently quick and easy through the modulated medium flow.

Moreover, forming of fundamentally new kinds of oriented and coherent vortex structures is possible, which arise only in the modulated medium flow. Forming of such stable periodically ordered vortex structures in modulated flow also lead to significant decrease of its hydrodynamic resistance and to significant increase of kinetic energy of medium flow. At the same time, velocity of dynamic pressure changes $d\Delta P_{m1}/dt$ also plays a significant (determinative) role in changing a state of turbulence and boundary layer of modulated medium flow. Said changes are connected with the form of modulation law $l_{m1}$ during the front time $t_{F1}$ and the back time $t_{B1}$. Therefore, the proposed energy optimal "drop-shaped" form of flow-forming energy modulation law $l_{m1}$ allows the selection of optimal values of the modulation parameters: frequency $f_{m1(opt)}$, range $b_{m1(opt)}$, front time $t_{F1(opt)}$, back time $t_{B1(opt)}$ and time ratio $\alpha_{m1(opt)}$ to provide an optimal minimal value of flow dissipation energy $E_{dm1(min)}$, optimal maximal value of flow kinetic energy $E_{km1(max)}$ and as the result—optimal minimal value of hydrodynamic resistance of modulated medium flow.

Figure 6:
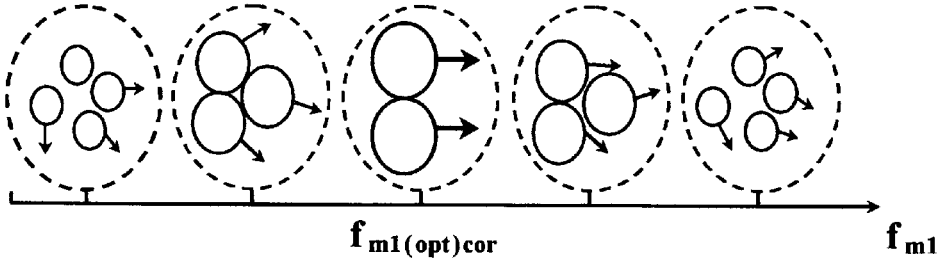
FIG. 6 is a view illustrating one of possible variants of a schematic presentation of a process of a change of a value of a hydrodynamic vectorization and a dominating size of medium particles of a modulated turbulent medium flow in dependence on a change of a value of at least one modulation parameter (frequency) during a dynamic structural energy optimization of the turbulent flow.

The elementary medium flow particles perform longitudinal movements with sign-alternating acceleration, normal to the fronts of said plane waves of modulated pressure. A computer modeling of the dynamic medium flow particle movements under an action of modulated pressure waves carried out by authors confirmed, that the spectrum of obtained "resonating" frequencies of oscillation movements of medium flow particles with maximal amplitude for different flows media (for example, water or air) are different. It have been established that said "resonating" conditions depend on the density, viscosity and temperature of flow medium. The experiments also show (for example, in the above-mentioned modulated medium flow), that the optimal frequencies of said plane waves are arranged in ultra-low and low frequencies ranges. The propagation of plane waves of modulated pressure is accompanied by suppression of the turbulence on the inner pipeline surface. An action of the plane waves of modulated pressure in the flow "interdicts" the evolution of small scale vortexes from the boundary layer surface (a growth of their instability) that decrease their generation and leads to growth of stability of large scale vortexes. These additional mechanisms of instability in the flow act differently on the turbulence particles of different scales. The above-mentioned minimal value $E_{Rm1(min)cor}$ (for $f_{m1(opt)cor}$) leads to optimization of maximal enlargement of turbulence particles and to their longitudinal vectorization movements (FIG. 6).

Figure 7:
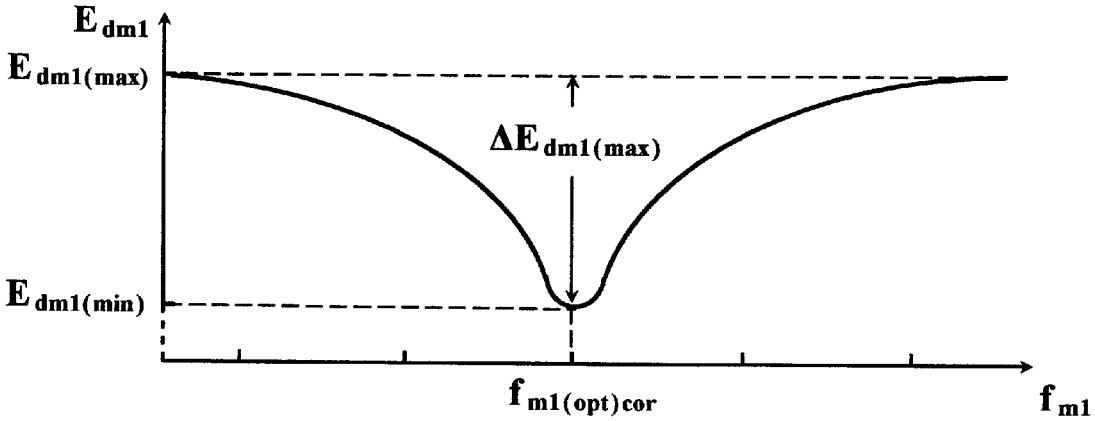
FIG. 7 is a view illustrating one of possible variants of a change of a value of dissipation energy of a modulated turbulent medium flow in dependence on a change of a value of at least one modulation parameter (frequency) during a dynamic structural energy optimization of the turbulent flow.

At the same time (for $f_{m1(opt)cor}$) the longitudinal movements of elementary medium flow particles with sign-alternating acceleration in the modulated flow serve as a continuous dynamic energy action of additional sources of hydrodynamic instability of boundary layer surface and hereupon its thickness and shear stress on the inner pipeline walls are decreased. These particles longitudinal movements increase a streamwise component of turbulent kinetic energy and decrease its azimuthal one. Therefore, a coefficient of turbulent viscosity is decreased and as a result, significant attenuation of the shear stress is occurred (especially in the pipeline wall layer). The modulated shear stress distribution is constantly below a steady one. Therefore, the dissipation energy in the boundary layer of modulated flow is decreased. This predetermines optimization of maximal decrease (on $\Delta E_{dm1(max)}$) of the dissipation energy $E_{dm1}$ of modulated medium flow from the maximal value $E_{dm1(max)}$ to the minimal value $E_{dm1(min)}$ (FIG. 7).

The medium flow longitudinal plane waves of the "drop-shaped" form of modulated flow-forming action $\Delta P_{pm1}$ in the pipeline are characterized by the predetermined back time $t_{B1}$ realizing the predetermined back extended part of said "drop-shaped" form of the law $l_{m1(opt)}$, which is greater than the predetermined front time $t_{F1}$ of realizing the predetermined front short part of said "drop-shaped" form of said law during the period $T_{m1}$ of negative modulating. Accordingly the mean value of amount of sign-alternating vortexes generated by the surface of boundary layer during the period $T_{m1}$ is negative, since the time $t_{B1}$ of recovery (increase) of pressure $\Delta P_{m1}$ in the modulated wave (from $\Delta P_{pm1(min)}$ to $\Delta P_{pm1(max)}$) corresponding to the generation of negative vortexes is greater than the time $t_{F1}$ of decrease of pressure $\Delta P_{pm1}$ in said wave (from $\Delta P_{pm1(max)}$ to $\Delta P_{pm1(min)}$). Therefore the modulated flow during the average modulation period $T_{m1}$ "rolls" on the negative vortexes, losing less energy against turbulent friction stress on the surface between of boundary layer and nucleus flow. On average (during the modulation period $T_{m1}$) a kinetic energy of modulated medium flow $E_{km1}$ is increased. The above-mentioned analysis has been qualitatively illustrated, for example, by results of the experimental visual research of modulated suction air flows, performed by authors. In the modulated air flows a longitudinal "helicoids" vortexes are formed. Similar hydrodynamic phenomenon so can take place in denser fluid media (for example, oil or water flows).

Figure 8:
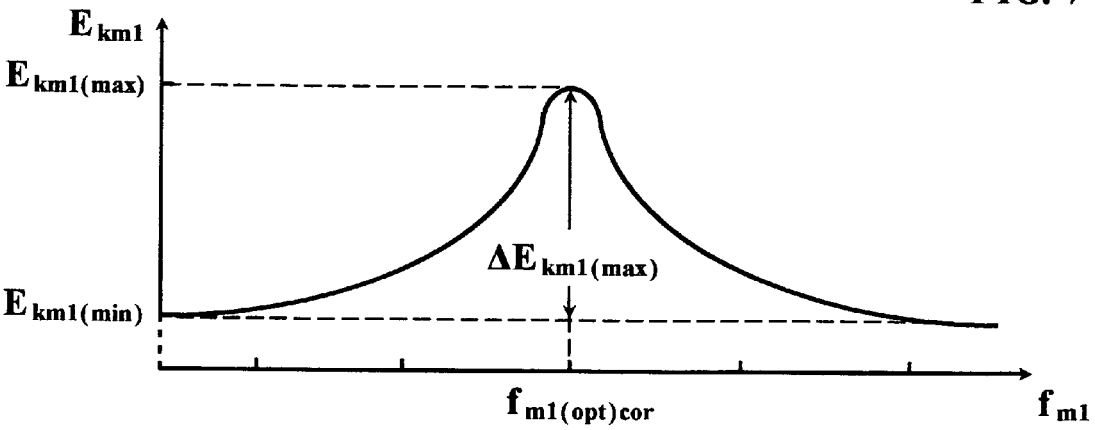
FIG. 8 is a view illustrating one of possible variants of a change of a value of kinetic energy of a modulated turbulent medium flow in dependence on a change of a value of at least one modulation parameter (frequency) during a dynamic structural energy optimization of the turbulent flow.

Relaminarization of the boundary layer and turbulent nucleus of medium flow is accompanied by suppression of turbulence in these flow zones by modulated pressure waves. Small scale unsteady vortexes, generated by the surface of the boundary layer are destroyed around it because of their instability and inability to penetrate in the nucleus of flow. This creates favorable conditions for enlarging of turbulent particles in the flow. An increase of the streamwise component of turbulent kinetic energy and formation of ordered longitudinally oriented turbulent structures leads to a decrease of the modulated turbulent viscosity and to the "pseudolaminarization" of flow. Such dynamic state of turbulence allows the flow on average to maintain the large scale turbulence structure and consequently on average to optimize maximal increase (on $\Delta E_{km1(max)}$ for $f_{m1(opt)cor}$) of the kinetic energy of modulated medium flow from the minimal value $E_{km1(min)}$ to the maximal value $E_{km1(max)}$ (FIG. 8).

Figure 5:
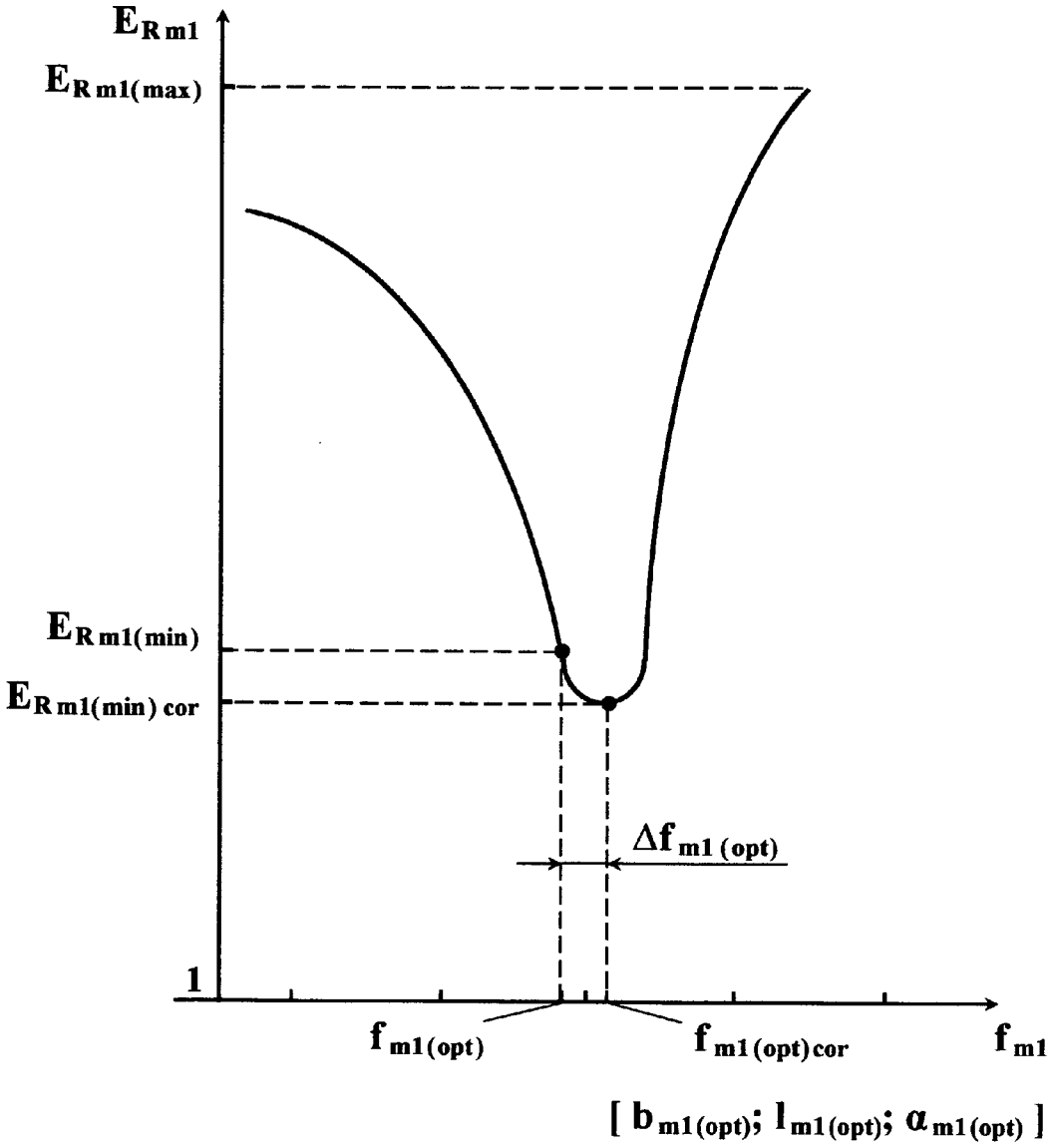
FIG. 5 is a view illustrating one of several possible variants of a change of a value of an energy ratio of a controlled acting value of a modulated medium flow-forming energy to a controlled acting value of formed kinetic energy of a modulated medium flow in dependence on a change of a value of at least one modulation parameter (frequency) during a dynamic structural energy optimization of the turbulent flow.

Computer simulations, performed by authors, confirmed that a domain of the search of above-mentioned optimal modulation parameters is significantly narrow (see FIG. 5). They can be provided only by possibilities of dynamic "thin" optimization parametric correction (for example, modulation frequency $f_{m1(opt)cor}$), for "resonance" structural energy tuning of modulated medium flow process. In this narrow "resonance" domain of changing of the optimal modulation parameters an uniformization of the spectrum of the turbulent particles of modulated medium flow occurs. The longitudinal "resonance" movements of said particles lead to significant structural energy changes of all pipeline medium flow. Such structural energy state of the flow is characterized by maximal interaction of modulated pressure wave with medium flow. The maximal value of transformation of energy of the modulated pressure wave into the energy of medium flow reflects the significant decrease of its hydrodynamic resistance. This is a consequence of fundamental restructurization-longitudinal anizotropization of nucleus and boundary layer of turbulent modulated medium flow. Therefore, in order to provide a dramatic minimization of the medium flow transporting energy consumption it is required to consume, for the structural energy optimization of modulated medium flow (by said negative modulating the flow-forming action), significantly less energy, than the energy of the pump at a constant pressure loss, which is necessary to provide the same non-modulated medium flow rate. At the predetermined "thin"-optimal modulation parameters of the plane waves of modulated pressure of flow-forming action, the hydrodynamic resistance of pipeline modulated medium flow can achieve a near zero value, that theoretically does not contradict to physical laws.

At the same time, it is necessary to note that the local longitudinal movements of the fluid particles with sign-alternating acceleration (in the oil flow longitudinal plane "drop-shaped" form waves of modulated flow-forming action $\Delta P_{pm}$) near the inner pipeline surface will lead to significant minimization of adhesion process, including paraffin coating of the oil pipeline wall. Beside this, the corrosion and bacterial process will also be minimized in the adhesion layer. Decrease of the adhesion leads to an increase of maintaining duration of evenness of pipeline inner surface. The use of modulation of flow-forming action allows the decrease of the acting value of a modulated pipeline medium flow overpressure $\Delta P_{pm(act)}$. Thus, the mean acting overpressure on the inner pipeline wall will also be significantly (by tens of percents) below the nominal overpressure, which is used in the modern operating pipeline. The longitudinal oscillations of elementary fluid particles in the modulated turbulent flow practically do not transfer energy to the pipeline wall in the radial direction, because their intensity of the turbulent radial movements is minimized. This leads to decrease of hydrodynamic erosion of inner pipeline walls. Said oscillations of fluid particles in the flow also lead to continuous "cleanup" of pipeline inner surface and prevents precipitation of impurities with a further coating formation (for example, paraffin coating of the oil pipeline inner surface). The above-mentioned prevents possible decrease of the pipeline cross-section and, as consequence, a possible increase of energy consumption that could be necessary to maintain the same medium flow pipeline capacity. All of the above-mentioned additional positive modulated energy hydrodynamic effects make more favorable conditions for pipeline operation, predetermine significant increase of the life of pipelines, and additionally have influence on minimization of the specific energy consumption of pipeline medium flow transporting process.

All above-mentioned physical phenomena, which take place in the modulated turbulent medium flow lead to significant optimization of a decrease of a value of the hydrodynamic friction coefficient. It can be decreased by the microprocessor-controlled optimization retrieval (for $E_{Rm1(min)cor}$) more than three times. A maximal value of optimization decrease of the hydrodynamic resistance of modulated medium flow (and correspondingly the pump energy consumption) can exceed fifty percent of the value of hydrodynamic resistance of non-modulated medium flow with analogous parameters of the flow transporting system. At the same time (for $E_{Rm1(min)cor}$), a maximal value of optimization increase of a rate of modulated medium flow can also exceed fifty percent of the value a rate of non-modulated medium flow. From the above analysis it follows that the specific energy consumption of medium flow pipeline transportation process can be decreased more than three times (at a significant decrease of the time of flow transporting of a given medium volume). This hydrodynamic state of the modulated flow is defined as the superconductive energy phenomena of the medium flow energy-saving transporting.

The above-mentioned consideration of the unique possibilities of new method of dynamic energy-saving superconductive transporting of medium flow is based on the particular analysis of the operation of the first dynamic subsystem shown in FIGS. 1 and 2. At the same time said variant of the scheme of functional structure of dynamic transporting system comprises two identical dynamic subsystems. The operation of the above-mentioned second dynamic subsystem is completely analogous to the operation of the first dynamic subsystem. The second dynamic subsystem also provides the energy superconductive (structural energy) optimization of the modulated medium flow in the pipeline with analogous modulation parameters $f_{m2(opt)cor}=f_{m1(opt)cor}$, $b_{m2(opt)}=b_{m1(opt)}$, $l_{m2(opt)}=l_{m1(opt)}$ and $\alpha_{m2(opt)}=\alpha_{m1(opt)}$, accordingly, realized by the energy-saving dynamic module 13 connected with the action means of medium flow-forming energy action—pump 9 (see FIG. 1). The medium flow longitudinal plane waves of the "drop-shaped" form of modulated flow-forming action $\Delta P_{pm2}$ in the pipeline, as an independent predetermined periodic process is directly connected with the above-mentioned process of modulating the flow-forming action $\Delta P_{pm1}$ in said pipeline (for example—the extended part of pipeline 8).

Figure 9:
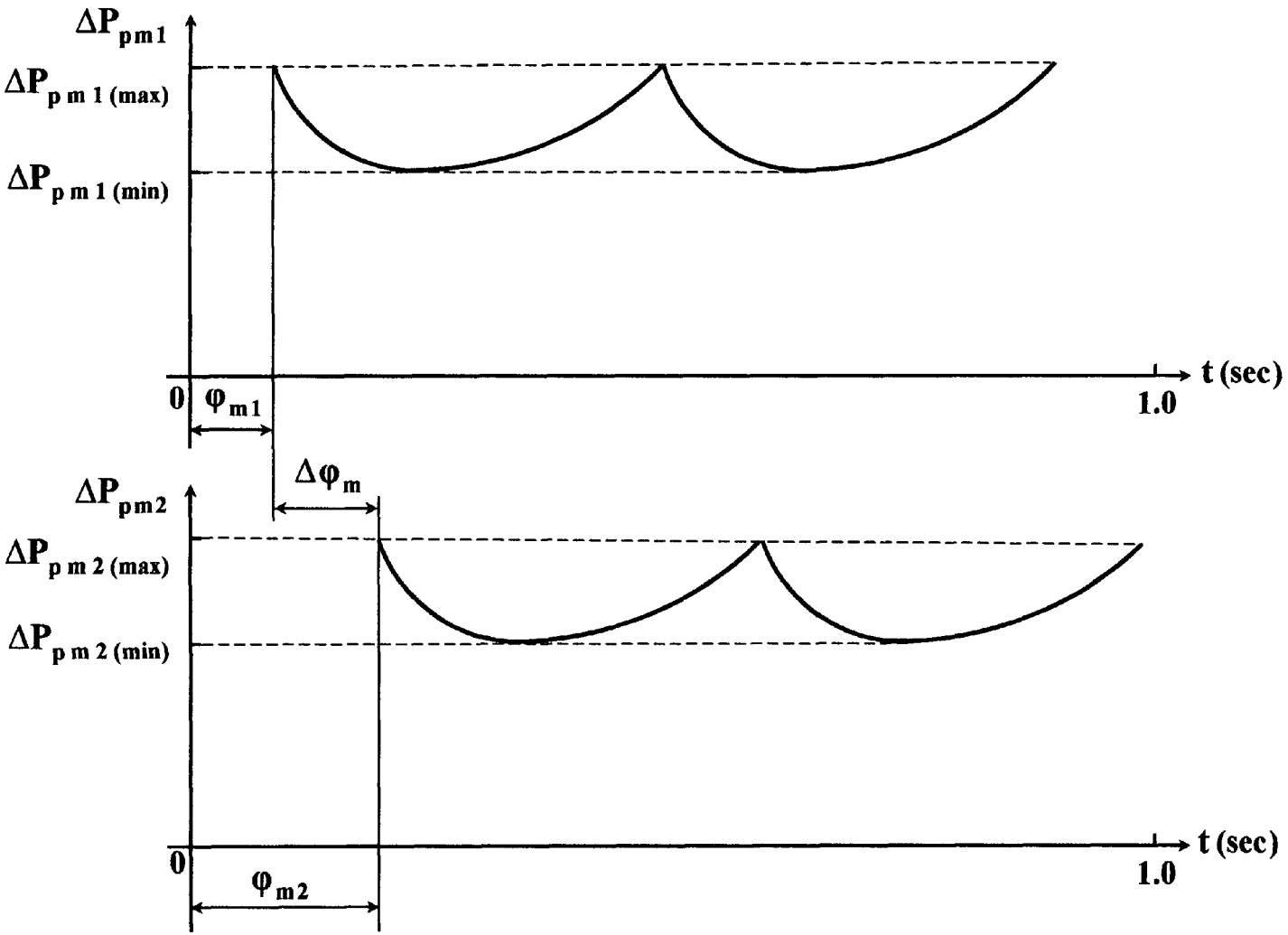
FIG. 9 is a view showing a diagram of an example of a phase shift, provided between predetermined comparative phases of two interacting processes of predetermined "drop-shaped" negative modulating of a value, of a medium flow-forming action, which is realized simultaneously by energy-saving dynamic modules with a first and a second means (pumps) of medium flow-forming action, for providing a modulated medium flow pipeline transporting system process.
Figure 10:
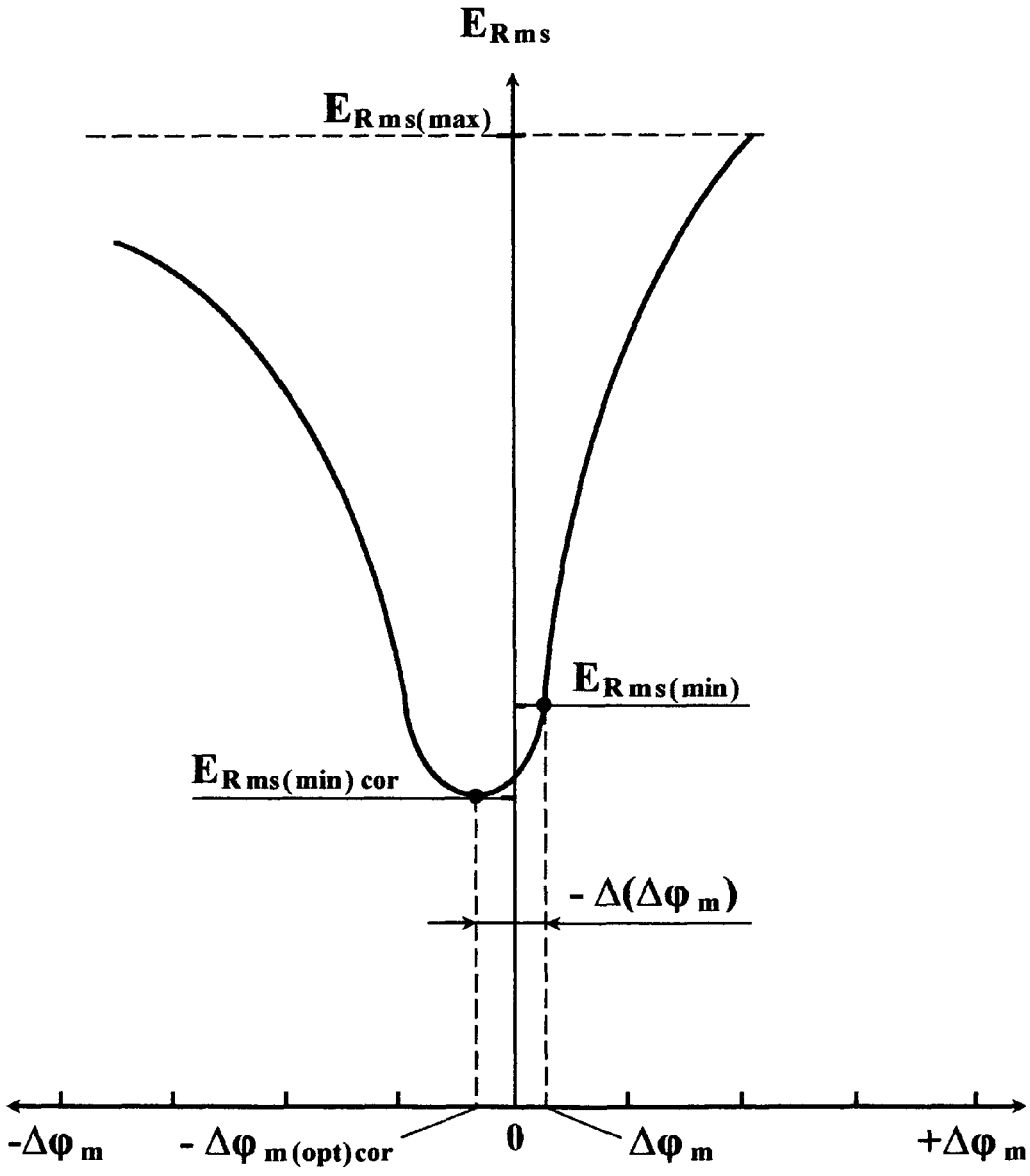
FIG. 10 is a view illustrating one of possible variants of a change of a value of the energy ratio of a controlled acting value of a modulated medium flow-forming energy to a controlled acting value of a formed kinetic energy of a modulated medium flow of a transporting system, comprising two means (pumps) of a modulated medium flow-forming action for providing a dynamic medium flow transporting system process, in dependence on a change of a value of a phase shift between two interacting flow modulating processes during a dynamic structural energy optimization of a modulated medium flow pipeline transporting system process.

The indicated modulating processes realize the flow-forming actions $\Delta P_{pm1}$ and $\Delta P_{pm2}$ in said pipeline simultaneously. However, the process of negative modulating of $\Delta P_{pm1}$ includes providing a predetermined comparative phase $\phi_{m1}$ (given at comparative moment of switching-on of energy-saving dynamic module 5) and the process of negative modulating of $\Delta P_{pm2}$ includes providing a predetermined comparative phase $\phi_{m2}$ (given at comparable moment of switching-on of the energy-saving dynamic module 13). Therefore, realization of the modulated flow-forming actions $\Delta P_{pm1}$ and $\Delta P_{pm2}$ in said pipeline at the start up situation describes a predetermined initial comparative phase shift between said modulated flow-forming actions: $\Delta\phi_m=\phi_{m2}-\phi_{m1}$ (FIG. 9). The presence of said initial phase shift $\Delta\phi_m$ with simultaneous modulated flow-forming actions $\Delta P_{pm1}$ and $\Delta P_{pm2}$ predetermines the negative interference of the wave's energy processes. It is a possibility of achieving of a minimally practical value of energy optimizing criterion $E_{Rms}$ for all dynamic transporting systems, comprising two identical dynamic subsystems. In said start up situation, when the initial phase shift is $\Delta\phi_m$, the energy optimizing criterion of the transporting system originally reaches the estimated minimal value of $E_{Rms(min)}$, which is significantly different from the practical value of $E_{Rms(max)}$ (FIG. 10).

The above-mentioned energy-saving dynamic modules 5 and 13 provide calculated initial real values of energy optimizing criteria ($E_{Rm1(min)}$ and $E_{Rm2(min)}$) and realize the microprocessor-controlled optimization retrieval of minimally practical values of $E_{Rm1(min)cor}$ (when the derivative $dE_{Rm1}/dt=0$) and $E_{Rm2(min)cor}$ (when the derivative $dE_{Rm2}/dt=0$) simultaneously. The achieved dynamic structural energy optimization in the turbulent flow is provided by minimally practical value of energy optimizing criterion for all dynamic transporting system $E_{Rms(min)cor}$, when said predetermined comparative phases $\phi_{m1}$ and $\phi_{m2}$ are automatically changed by the value of $-\Delta(\Delta\phi_m)$ by the energy-saving dynamic module 5 and 13, to provide a phase shift $-\Delta\phi_{m(opt)cor}$ when the value of derivative is $dE_{Rms}/dt=0$ (see FIG. 10).

Figure 11:
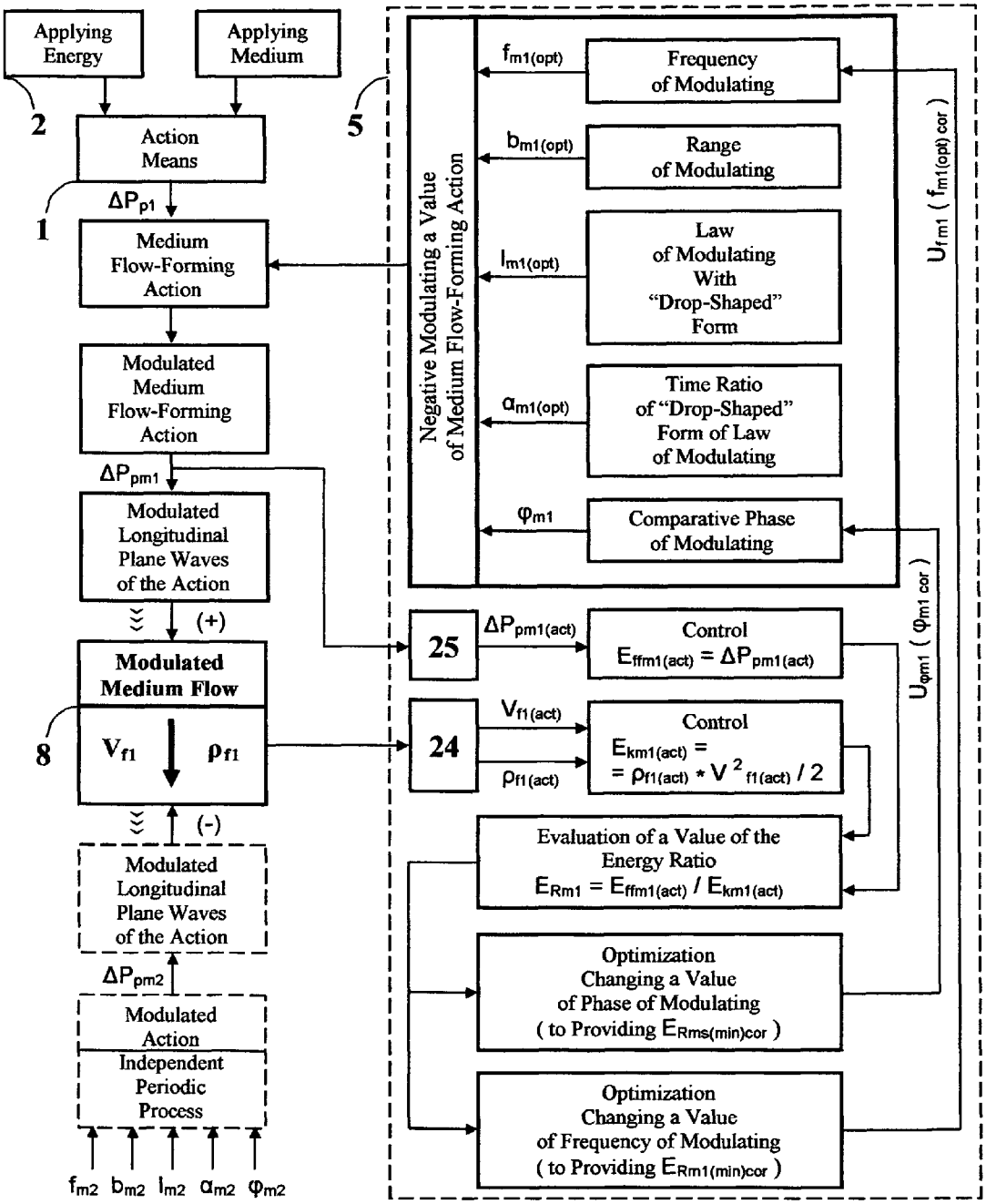
FIG. 11 is a view showing one of possible variants of a scheme of a functional structure, which graphically illustrates the method steps of the claimed method of dynamic energy-saving superconductive transporting of medium flow in accordance with the present invention for one of possible variants of the operation of said dynamic transporting system (FIGS. 1 and 2) during the particularly depicted process of a dynamic structural energy optimization of a modulated medium flow.

The above-mentioned process (for example, in the energy-saving dynamic module 5) of the automatically changing the value of predetermined comparative phases $\phi_{m1}$ is realized by the microprocessor control block 16. The sensor 24 and sensor 25 control of the values of technological parameters: $V_{f1(act)}$, $\rho_{f1(act)}$ and $\Delta P_{pm1(act)}$, coming in the microprocessor control block 16 for above-mentioned calculation of an initial real value of energy optimizing criterion $E_{Rm1(min)cor}$, which (in said start up situation) corresponds to the value of $E_{Rms(min)}$. The microprocessor-controlled optimization retrieval of a minimally practical value of $E_{Rms(min)cor}$ provides the change of the estimated value of optimal modulation parameter $\phi_{m1}$ to the correction value of $\phi_{m1cor}$ by the change of the signal $U_{\phi m1}$ (to $U_{\phi m1cor}$) connected with the drive 22. The signal $U_{\phi m1}$ of (for example) the impulse form with the parameters: amplitude, sign, form and duration, is optimizational changed by the microprocessor control block 16 during optimizational retrieval of a minimally practical value of $E_{Rms(min)cor}$. The present impulse signal $U_{\phi pm1}$ provides an impulse braking (or accelerating) of the rotation of the drive 22 of the movable cylindrical valve element 20 that gives an impulse to optimization retrieval of the value of $\phi_{m1cor}$. The optimization retrieval of the value of $\phi_{m2cor}$ in the energy-saving dynamic module 13 is provided reciprocally and simultaneously by the above-mentioned optimization retrieval of the value of $\phi_{m1cor}$, that predetermines the system optimization retrieval of the minimally practical (superconductive) value of $E_{Rms(min)cor}$ (see, for example, FIG. 11).

The proposed (for the first time) automatic control of a phase of the negative modulating of flow-forming actions provides a qualitatively new possibility for the energy-effective and structural energy (superconductive) optimization in similar multi-pumps (connected consecutively or in parallel with pipeline) system of dynamic medium flow processes by changing a value of at least one modulation parameter in dependence on a change of a value of at least one controlled technological characteristic.

The above-mentioned predetermines a possibility of extensive use of the proposed new method of dynamic energy-saving superconductive transporting of medium flow in various fields of the energy-consuming flow pipeline transportation market, covering (for example) transport, industry, military, environment, medical, household and also including different groups of dynamic pipeline transportation systems with total length of tens of millions of miles (existing systems, which will be equipped with the energy-saving dynamic modules and new dynamic systems):

Dynamic local pipeline transportation systems: air purification and conditioning, heat and mass exchangers, fuel or/and water supply, flowable media loading, physiological media etc.;

Dynamic industrial pipeline transportation systems:

technological materials—granules, powders, chemical and gas components etc, petroleum products, natural gas, fluid materials and excavated products, fuel, water, heat and mass exchangers, air purification and conditioning, tankers etc.;

Dynamic network pipeline transportation systems: water, natural gas etc.;

Dynamic trunk pipeline transportation systems: water, natural gas, crude oil, fluidized coal, minerals and ores etc.

For example, using of the new developed dynamic energy-saving superconductive medium flow pipeline transporting process in the traditional oil loading/unloading tanker pumping systems will provide considerable increase (about twenty-forty percent) of the oil flow velocity (pipeline capacity) and considerable decrease (about two-three times) of the specific energy consumption. Herewith, it will provide the considerable time decrease (about thirty percent) required for oil loading/unloading process and cost of stay of tanker in a terminal, and a significant increase of economic and exploitation efficiency of terminals and tanker fleet. A similar use of the energy-saving medium flow pipeline transporting process in air refueling of aircrafts will lead to analogous decrease of the refueling time, energy consumption, and also—of size and weight of the aircrafts' pumping systems.

The energy-saving dynamic modules of similar dynamic pipeline transportation systems can have different schematic, structural and functional solutions. One of the possible variants of the functional construction of the valve block of the energy-saving dynamic module, which is a new so-called "hollow shell" variant, is shown in FIG. 2. It can be a universal schematic solution for producing dynamic modules for different applications. In general, various variants of the construction of the modulating valve block and various algorithms of operation of the compact intellectualized energy-saving dynamic module are described in detail, for example in our above-mentioned U.S. patents. At the same time it is necessary to note that the realization of the new method of dynamic energy-saving superconductive transporting of medium flow in various applications can require specific changes in the operation of the microprocessor control block, valve block or/and sensors control of the technological parameters.

The above-mentioned microprocessor control block 16 of the functional structure of energy-saving dynamic module 5 can include:

the above-mentioned so-called "modulation—hydrodynamic model of Relin—Marta", integrated in operation algorithm of this block for providing an universal parametric functionality by automatic correction of computer estimated optimal modulation parameters at an entry in the block of new given parameters of pipeline system, of the modulated medium flow or/and flow medium and also—of the controlled current optimization parameters of modulated medium flow or/and flow medium;

additional discrete inputs for setting of new given parameters of pipeline system, of modulated medium flow or/and flow medium;

additional optimization parametric inputs for setting of the new controlled current optimization parameters of modulated medium flow or/and flow medium;

additional controlling outputs, which are connected for example, with specifics canals of a multi-canal valve block or/and with additional drive for movement of the above-mentioned control element (ring) for required complex correction of computer estimated optimal modulation parameters of the cylindrical valve elements of the valve block.

The microprocessor control block can realize various algorithms of a single- and multi-parameter optimization control of the parameters of the modulation for providing a single- or multi-parametric optimization of the process of dynamic energy-saving superconductive medium flow transporting. For providing special technological requirements one can use the optimization algorithm including maintenance of given controlled acting value of modulated medium flow velocity and providing a minimal value of the energy ratio $E_{Rm(min)}$ simultaneously.

The additional controlling output, which is connected with the additional drive for movement of the above-mentioned control element (ring) can be connected, for example, with an electromagnetic drive providing a possibility of given linear displacement or given angular displacement of the control element (ring). These displacements are needed for complex correction of the above-mentioned computer estimated optimal modulation parameters ($b_{m(opt)}$, $l_{m(opt)}$ and $\alpha_{m(opt)}$) of cylindrical valve elements of the valve block.

The multi-canal valve block can include a longitudinal (coherent) disposition of several sectional cross-sections of the through canals. They are formed (simultaneously, alternatively or selectively, for example by the movable control element) during the rotation of the movable cylindrical valve element relative to the immovable cylindrical valve element. Others possible variants of the functional construction of the multi-canal valve block of the energy-saving dynamic module can include a parallel disposition of several above-mentioned "longitudinal" single- or multi-canal switches of movable valve couples. Each of them includes movable and immovable cylindrical valve elements and also—a controlling drive. In some schematic solutions of the valve block the independent control element (ring) can be excluded. The functional role of this element can be carried out for example either by the immovable cylindrical valve element, which can be movable in the longitudinal and angular directions, or by the movable cylindrical valve element, which can be movable in the longitudinal direction (possibly with its drive). The selected several sectional cross-sections' of the through canals of the multi-canal valve block can provide a different complex of the modulation parameters ($l_m$, $b_m$, $\alpha_m$ and $T_m$) for realization of the microprocessor-controlled optimization retrieval of a minimally practical values of $E_{Rm(min)}$.

The above-mentioned different additional functional and technical possibilities of the microprocessor control block and valve block can provide a change of the value of the time ratio $\alpha_m$ (as an additional predetermined modulation parameter of said negative modulating) in dependence on a change of a value of at least one characteristic connected with said dynamic medium flow process to provide a minimal value of the energy ratio $E_{Rm(min)}$. Such changes of said value of the time ratio during the realization of predetermined period $T_m$ of said "drop-shaped" form of said modulation law can include:

technical change of a predetermined front time $t_F$ and providing a predetermined period $T_m$ of said negative modulating simultaneously;

technical change of a predetermined period $T_m$ of said negative modulating and providing a predetermined front time simultaneously;

technical change of a predetermined front time $t_F$ and a predetermined period $T_m$ of said negative modulating simultaneously.

The above-mentioned realization of the automatic control of predetermined phase $\phi_m$ of negative modulating the flow-forming actions can also use different technical solutions, for example:

turning of the immovable cylindrical valve element of the valve block over a given angle by a stepping motor;

turning of a body of drive of movable cylindrical valve element over a given angle by the stepping motor;

turning of the movable cylindrical valve element over a given angle by the stepping motor (or selsyn motor), which is used as its drive etc.

The above-mentioned controlled acting value of said modulated medium flow-forming energy can be evaluated with the use of, for example: a controlled acting value of a modulated medium flow pressure, provided by said action means of medium flow-forming action (pump); or a controlled acting value of at least one energy parameter, connected with a value of energy consumption of said action means of medium flow-forming action (drive of the pump). At the same time, the above-mentioned controlled acting value of kinetic energy of said modulated medium flow can be evaluated with the use of, for example: a controlled acting value of a modulated medium flow velocity and a predetermined value of a flow medium density, or a controlled acting value of a modulated medium flow velocity and a controlled acting value of a flow medium density.

The above-mentioned energy-saving dynamic module, which realizes the principle of controlled inner dynamic shunting of working zones of the pump, can be parallel-connected with the action means of medium flow-forming action, including only one pump or the compact multi-pumps (consecutive or parallel-connected with pipeline) system. At the same time, for example the air flow pipeline transporting systems can use the energy-saving dynamic module, which realizes the principle of controlled exterior dynamic shunting of a selected portion of a modulated suction air flow, connected with suction working zones of said means of air flow-forming action. The same medium flow pipeline transporting systems can use both variants of the above-mentioned energy-saving dynamic modules simultaneously, and can realize (in these both variants) dynamic shunting. It includes providing a controlled predetermined periodic connection of the modulated suction medium flow with modulated shunt medium flow, which is realized around of said suction flow. Besides, the new method makes possible a realization of one of several main variants of said negative modulating of a value of the medium flow-forming action. It includes providing the controlled predetermined dynamic periodic change of a value of at least one parameter, dynamically connected with the process of conversion of a consumption energy to said modulated medium flow-forming action realizable in said means (for example, a pump) of medium flow-forming action (described in detail, for example in the above-mentioned our U.S. patents).

The above-mentioned proposed supereffective use of the proposed new method of dynamic energy-saving transporting of medium flow in the dynamic transporting system (comprising two identical dynamic subsystems) is an example of realization of the superconductive transporting of modulated medium flow in combination with the above-mentioned independent predetermined periodic process. It can include modulating of a value of a medium flow-forming action of an additional action means of medium flow-forming action directly connected with said modulated medium flow (an object of energy action) in the common pipeline, which is a working zone of action.

At the same time, the above-mentioned new method can be also used energy efficiently and in different various technological applications, when the above-mentioned independent predetermined periodic process can include a modulating value of a medium flow-forming action of at least one additional action means of medium flow-forming action connected with said modulated medium flow in least one medium flow action working zone including at least one medium flow action object. And besides, the above-mentioned medium flow action working zone can include, for example at least one perforating inlet to provide perforated medium flows, and the above-mentioned medium flow action object can be, without any limitation, for example: an object of porous, filter or constructive structure, a porous medium saturated object or a specific detection object.

The examples of similar technological applications can be, without any limitation, different methods and systems of dynamic superconductive energy optimizing of perforated medium flows action, which can be based on realization of the above-mentioned new proposed modulation method. The known similar perforated medium flows action system comprises at least one perforated medium flows action unit including at least one action means of medium flow-forming action, at least one medium flow suction pipeline or/and at least one medium flow power pipeline with at least one action perforated part. And besides, an exterior surface of said action perforated part is connected with at least one medium action working zone including at least one medium action object. The above-mentioned method of energy optimizing (realized for example, with use of at least one above-mentioned energy-saving dynamic module) can comprise modulating of value of said medium flow-forming action of at least one said means of at least one said unit and also—above-mentioned optimization changing of a value of at least one parameter of said modulating in dependence on a change of a value of at least one characteristic connected with a medium flows action process realizable in said medium action working zone for dynamic space-temporal structural energy optimization, in an energy-effective manner, of said medium flows action process.

The above-mentioned systems of dynamic superconductive energy optimizing of perforated medium flows action can be used in different technological applications, without any limitation, for example:

- oil extraction technology by dynamic forcing of oil from a bed porous structure (or from an oil bed bank) using dynamic multijets injection of perforated medium action flows (water, gas or mixtures) through perforated casing of injection well to action working zone of porous medium saturated with oil (or to action working zone of oil bed bank);
- oil extraction technology by dynamic suction of oil from the bed porous structure (or from the oil bed bank) through a production well perforated casing adjacent to action working zone;
- gas extraction technology by dynamic suction of gas from the bed porous structure (or from the gas bed bank) through a production well perforated casing adjacent to action working zone;
- water extraction technology by dynamic suction of water from the bed porous structure (or from the water bed bank) through a production well perforated casing adjacent to action working zone;
- uranium extraction technology by dynamic forcing of uranium from a bed sandstone (or ore body) porous structure using the dynamic multijets injection of perforated medium action flows (for example, water plus oxygen) through a perforated casing of injection well to action working zone of porous medium saturated with uranium;
- uranium extraction technology by dynamic suction of uranium from the bed sandstone (or ore body) porous structure through a production well perforated casing adjacent to action working zone;
- chemical substances catalysis technology with use of perforated medium flows action on a catalytic action working zone of chemical reactor;
- cleaning and coating technologies with use of perforated medium flows action on a movable (or immovable) action object in the action working zone;
- operational detection technologies with use of perforated medium flows action on a movable (or immovable) action object in action working zone, wherein simultaneously with said characteristics connected with a medium flows action process, additionally at least one specific detection space-geometrical, structural, physical and/or chemical parameter of said medium action working zone and/or said medium action object or a part of said medium action object is controlled; etc.

In the process of realization of the new dynamic method of energy optimizing in the above-mentioned dynamic energy-saving systems technological characteristics can be used, which are connected with said medium flows action process and are selected from the group consisting of (but not limited): an energy consumption of said acting means of medium flow-forming action (for example, a pump energy consumption); a pressure, a temperature and/or a rate of said medium flow; a space-geometrical, structural, physical and/or chemical parameters of said medium action working zone and/or said medium action object; an energy, rate, velocity parameters of said medium action object; a dynamic energy parameters of at least one another action means of medium flow-forming action on said medium action object (for example, other pump energy consumption); and also—a frequency, a range, a law, and/or comparative phase of said other modulated medium flow-forming action.

It should be noted, that said modulated perforated power medium flow—a so-called "exterior" flow (for example, pressing into water flow) and said modulated perforated suction medium flow—a so-called "interior" flow (for example, a stamping out of the oil flow) in said medium flow action working zone (for example, the oil-saturated porous structure) are connected with each of them. This provides a control of optimization of a value of predetermined comparative phase shift between predetermined comparative phases of said modulations of said exterior and said interior medium flows. Such optimization will provide, on average (during the modulation period $T_m$), a maximal fluidity of said oil flow and its maximal rate.

Besides, said changing a value of at least one parameter of said negative modulating (with the use of the proposed phase automatic control, medium flow longitudinal plane waves of the "drop-shaped" form of modulated flow-forming action and energy optimizing criterion) includes providing a maximal efficiency of a complex medium flow-forming action on said medium action object and a minimal value of a complex energy consumption during said medium flows action process, simultaneously—which is a superconductive energy mode. Herewith, said superconductive energy mode of said medium flows action process includes optimizing of dynamically modulated turbulent structure and energy of said medium flows action, to provide, in an energy-effective manner, maximal dynamic energy of said modulated medium flows action on said medium action object and to provide a structural energy 'resonance' response of a medium action object system by optimization of dynamic parameters of said modulating.

The above-mentioned new systems of dynamic superconductive energy optimizing of perforated medium flows action, realizing the proposed new modulation principles of the energy optimization process of perforated modulated medium flows, can provide the following qualitatively new advantages, for example:

- a significant decrease (more than two times) of energy consumption by dynamic multijets perforated injection medium flows action on the working zone of medium action adjacent to perforated part of medium suction (or power) pipeline of the dynamic perforated medium flows action system;
- a significant decrease (more than two times) of hydrodynamic resistance of medium flow suction (or power) pipeline and its perforated canals; a significant decrease of adhesion on the interior surface of the medium flow suction (or power) pipeline and perforated canals, that leads to significant increase of their useful time;
- a dynamic perforated medium flows action on the action working zone;
- a continuous energy action of modulated plane pressure waves on the action working zone leads to movements of elementary fluid particles of medium flow with sign-alternating acceleration (for example, oil flow in bed porous structure); herewith, these particles movements lead to decreasing of adhesion processes in bed pores, prevent their blocking (effective dynamic antiblocking process), maintain the pores in open state and lead to decreasing of pore hydrodynamic resistance; at the same time, the movements of elementary fluid particles of heterogeneous medium flow with sign-alternating acceleration lead to medium "loosening" and consequently increasing its fluidity (for example, oil);
- a significant increase (about 1.5-2 times) of medium flow rate from the bed porous structure in the action working zone (for example, oil or uranium ore) with minimal total energy consumption—superconductive energy mode;
- a significant increase (about 1.5-2 times) of a velocity displacement of medium from the bed porous structure of action working zone (for example, oil or uranium ore);
- wider possibilities of optimization of technological process (suction or replacement) with use of a control of its characteristics for one or many perforated medium flows action units in the system;
- a maximal use of possibilities of exploitation of traditional perforated medium flows action systems with additional use of energy-saving dynamic module, realizing said modulation of a value of said medium flow-forming action of at least one means of at least one perforated medium flows action unit.

Others demonstrative examples of similar technological applications can be, without any limitation, different methods and systems of dynamic superconductive energy optimizing of treatment/filtering, based on realization of the above-mentioned new proposed modulation method. The known similar filtering system for providing a carrying medium flow treatment/filtering process (for example, wastewater filtering system), comprises at least one action means of flow-forming action (for example, a pump) on a suction or/and pressure pipelines and at least one treatment/filter block. The above-mentioned method of energy optimizing (realized for example, with use of at least one above-mentioned energy-saving dynamic module) can comprise modulating of a value of said carrying medium flow-forming action of at least one said means and also—above-mentioned optimization of changing a value of at least one parameter of said modulating in dependence on a change of a value of at least one dynamic treatment/filtering process characteristic for dynamic structural energy optimization, in a energy-effective manner, of the carrying medium flow treatment/filtering process.

The development of the above-mentioned new class of different dynamic energy-saving superconductive medium flow treatment/filter systems, which will provide the dynamic superconductive energy optimizing of the carrying medium flow treatment/filtering process, can be used in various technological applications, without any limitation, for example in water treatment/filtering industry:

- dynamic water microporous pressure filter systems;
- dynamic water screen microporous pressure filter systems;
- dynamic water ultra fine pressure filter systems;
- dynamic water GAC pressure treatment systems;
- dynamic water gravity filter systems;
- dynamically managed air systems (for cleaning of water filter block) etc.

Besides, similar dynamic superconductive energy-saving medium flow treatment/filter systems can be developed also for different super treatment/filtering technological processes, without any limitation, for example: media, cartridge, membrane filtration, reverse osmosis, carbon adsorption, ultraviolet and chemical disinfections, and also—aerobic biological technological processes.

The optimization changes of a value of at least one parameter of said negative modulating (with the use of proposed phase automatic control, medium flow longitudinal plane waves of the "drop-shaped" form of modulated flow-forming action, and energy optimizing criterion) include providing a mode of maximal energy-filtering quality efficiency of the complex carrying medium flow-forming action on said treatment/filter block (a minimal value of a complex energy consumption during the carrying medium flow treatment/filtering process) and maximal treated/filtered carrying medium flow rate, simultaneously—which is a superconductive energy flow treatment/filtering mode. It should be noted, that modulated carrying wastewater flow and modulated treated/filtered carrying water flow are interconnected in the filter/treatment block and controlled independently. This creates a possibility of optimization of a value of predetermined comparative phase shift between the predetermined comparative phases of said modulations of said wastewater and said treated/filtered carrying water flows. Such optimization will provide, on average (during the modulation period $T_m$), a maximal volume fluidity of said water flow in filter/treatment block and a maximal treated/filtered flow rate.

The medium flow longitudinal plane waves of the "drop-shaped" form of modulated flow-forming action are propagated through the flows of different carrying medium in a pipeline and the treatment/filter block structures. It provides a structural energy 'resonance' response of the medium action object-treatment/filter block structure by optimization of the dynamic parameters of said modulating and predetermines a minimization of its blocking because the first realizable new dynamic antiblocking mechanism provides, without any limitation, for example:

- continuous prevention of a cake stabilized form and maintaining of "dynamic-breathing" treatment/filter block structure cake in the loosened-porous state;
- minimization of probability of cluster formation and a minimization of fluid particles settling on said treatment/filter block structure;
- minimization of probability of impurity particles settling inside a treatment/filter block structure pores and an increase of fluidity through said structure;
- minimization of probability of beginning of one-layer cluster formation on a treatment/filter block structure surface.

The above-mentioned new dynamic energy-saving superconductive medium flow treatment/filter systems, realizing the proposed new modulation principles of the energy optimization of the different carrying medium flow treatment/filtering process, will provide the following qualitatively new advantages, for example:

- essentially better quality of treatment/filtering process as compared to any exiting modern technology in this field;
- essential increase (about two times) of treatment/filtered medium flow productivity for any existing and new dynamic medium flow treatment/filter systems;
- essential decrease (about 1.5-3.0 times) of specific energy consumption by treatment/filtering process;
- improvement of operational characteristics of any existing and new dynamic medium flow treatment/filter systems including minimization of treatment/filtering system canals congestion (e.g. rise in durability of downtrodden medium flow pipelines);
- new dynamic possibilities of micro-structural influence on blocking mechanisms inside the structure of the system treatment/filter block—which are new dynamic untiblocking mechanisms;
- creation of qualitatively new dynamic possibilities for automatic multi-parametric optimization of dynamic medium flow filtering, treatment and managed processes;
- local longitudinal movement of the carrying medium flow fluid particles with sign-alternating acceleration near an inner pipelines surface will lead to significant minimization of adhesion, corrosion and bacterial processes inside all components of the treatment/filter systems, that will predetermine the extra possibilities of improvement of medium flow treatment/filter quality;
- significant decrease of pressure on the inner pipeline wall and treatment/filter system components, providing more comfortable mode of exploitation of dynamic treatment/filtering systems;
- significant increase of life time of dynamic treatment/filtering systems;
- essential decrease of specific expenses in conjunction with medium flow purification process.

Said factors predetermine more efficient energy and exploitation characteristics of new dynamic superconductive energy-saving superconductive medium flow treatment/filter systems, which will revolutionize a wide range of applications in numerous medium flow treatment/filter fields. Furthermore, a possibility of development of various compact modern dynamic components (energy-saving dynamic modules) allows re-equipping of the existing treatment/filter systems as well as their utilization in newly developed dynamic systems.

The above-mentioned examples of the two new classes of different dynamic energy-saving superconductive medium flow technological systems is only a small part of a wide classification group of newly developed similar dynamic energy-saving systems, which provide the "supereffective" dynamic flow action on the object and cover, without any limitation, for example:

- dynamic vacuum cleaning systems (manual, build in, mechanized and special, for example—underwater);
- dynamic medical suction systems and instruments (surgical, dental, liposuction, testing, gynecological, massaging procedures etc.);
- dynamic pumping systems for treatment or cleaning of object surfaces;
- dynamic systems for selection of small objects;
- dynamic suction mineral concentration systems (gold, coal, uranium etc.);
- dynamic vacuum systems for forming of mixtures;
- dynamic dusting systems;
- dynamic systems for special usage (dynamic suction/power systems for detection of components on moving objects); etc.

Others examples of the similar technological applications can be, without any limitation, different methods and systems of dynamic energy-saving superconductive flow heat transfer, which are based on the realization of the above-mentioned new proposed modulation method. These new dynamic systems realize a complex of two energy optimization tasks: the above-mentioned dynamic medium flow pipeline transporting and dynamic medium flow action on the object, which is a thermal boundary layer of said dynamic medium flow. The known similar flow heat-transferring system for providing a heat-transferring process (for example, a heat-transferring system for gas liquefaction), comprises, for example, at least one means of medium flow-forming action (for example, pump), at least one supply pipeline and at least one discharge pipeline for transporting of heat transfer medium flow, at least one heat exchanger including at least one flow heat transfer canal for an interior heat transfer medium flow, disposed inside of heat exchanger shell containing an exterior heat transfer medium of said canal. The above-mentioned method of energy optimizing of said heat transfer process (realized for example, with use of at least one above-mentioned energy-saving dynamic module) can comprise modulating of a value of said heat transfer medium flow-forming action of at least one means and also—above-mentioned optimization changing of a value of at least one parameter of said modulating in dependence on a change of a value of at least one technological characteristic connected with an energy efficiency of said heat transfer process, for dynamic structural energy optimization, in an energy-effective manner, of the flow heat transfer process:

The development of above-mentioned new class of different dynamic energy-saving superconductive flow heat-transferring systems, which will provide the dynamic superconductive energy optimizing of the heat transfer medium flow process, can be used in various technological applications, without any limitation, for example:

- flow heat-transferring processes in chemical industry (petroleum refining and petrochemical processing);
- generation of steam for production of power and electricity;
- nuclear reactor systems;
- in the field of cryogenics (as in low-temperature separation of gases and gases liquefaction);
- flow heat transfer during liquid vaporization;
- flow heat transfer during steam condensing;
- food industry (for pasteurization of milk and canning of processed foods);
- aircraft and vehicles;
- heating, ventilating, air conditioning and refrigeration etc.

In the process of realization of the new dynamic method of energy optimizing in the above-mentioned dynamic energy-saving superconductive flow heat-transferring systems it is possible to use said technological characteristics connected with the energy efficiency of said heat transfer process and selected from the group consisting of (without any limitation): an energy consumption by said action means of medium flow-forming action (for example, a pump energy consumption); a dynamic energy parameters of at least one additional action means of medium flow-forming action (for example, another pump energy consumption into a "double-canal" heat exchanger) and also—a frequency, a range, a law, and/or comparative phase of said additional modulated medium flow-forming action, for example in a "double-canal" flow heat exchanger; a temperature of said interior heat transfer flow medium; a temperature of said exterior heat transfer flow medium; a rate of interior heat transfer medium flow; a rate of exterior heat transfer medium flow; a heat transfer flux etc.

With the realization of the method of energy optimizing, where a flow heat exchanger is a flow heat exchanger of the type "double-canal" (for example, "double-pipe") said modulating of a value of at least one interior heat transfer medium flow-forming action and said additional modulating of a value of at least exterior heat transfer medium flow-forming action will be provided simultaneously. The both modulating types include providing a predetermined comparative phase shift of said modulations. They can be changed by changing a phase at least one modulating during said flow heat transfer process in dependence on a change of a value of at least one of the above-mentioned characteristic. In this case, said additional modulating value of at least one exterior heat transfer medium flow-forming action is an independent predetermined periodic process constructively connected with modulated interior heat transfer medium flow. The possibility of the optimization control of a predetermined comparative phase shift between the predetermined comparative phases of said modulations of said exterior and said interior heat transfer medium flows will provide, on average (during the modulation period $T_m$), a minimal value of a thickness of a thermal boundary layers along the whole heat exchange surface, and also—a maximal value of the heat flux (for example, on the surfaces of "double-pipe" of said flow heat exchanger of the type "double-canal").

Besides, said changing of a value of at least one parameter of said negative modulating (with the use of proposed phase automatic control, medium flow longitudinal plane waves of the "drop-shaped" form of modulated flow-forming action and energy optimizing criterion) includes providing a mode of maximal value of a heat transfer flux and a minimal value of a complex energy consumption during the heat transfer medium flow process, simultaneously—which is a superconductive flow heat-transferring energy mode. Herewith, the medium flow longitudinal plane waves of the "drop-shaped" form of modulated flow-forming actions are propagated through said heat exchanger pipelines ("double-pipe") and provide a structural energy 'resonance' response of the medium action object—a "double thermal boundary layer" of said dynamic medium flows double structure by optimization of the dynamic parameters of said modulations.

The above-mentioned new dynamic energy-saving superconductive flow heat-transferring systems, realizing the proposed new modulation principles of the energy optimization of the different heat transfer medium flow process, will provide the following qualitatively new advantages, for example:

- continuous action of a mechanism of hydrodynamic instability progress of the surface of boundary layer of turbulent heat transfer medium flows (new method of dynamic control of boundary layer);
- forming of pressure "standing wave" ("virtual turbulator"), which lead to dynamic wave-deformation of structure of hydrodynamic and thermal boundary layers and minimization of their thickness;
- minimization of the energy losses in the heat transfer medium flows due to modulated optimization of parameters of elementary fluid particles (for example: dimension, density, viscosity, and their amplitude-frequency characteristics);
- energy self-organization "resonance" of the turbulent structure of heat transfer medium flows;
- maximal value of a turbulent heat flux on the canal wall of heat exchanger;
- significant minimization of all fouling mechanisms of a heat-transferring surface (for example: crystallization, sedimentation, coking, corrosion etc.) and also—decrease of adhesion and bacterial actions on the heat-transferring surface;
- significant increase of heat-transferring coefficient on the heat transfer surface;
- decrease of requisite heat transfer medium flow rates (interior and exterior), and decrease of pumping energy consumption;
- significant decrease of specific energy consumption of flow heat-transferring process in the heat exchanger;
- significant increase of a value of vaporization process velocity of a heat transfer liquid flow;
- significant increase of a value of velocity of a heat transfer gas flow in liquefaction process;
- significant increase of a value of a heat-transferring coefficient during the processes of vaporization and condensation, for example, in air-conditioning systems;
- significant decrease of a size and weight of flow heat-transferring and air-conditioning systems;
- increase of life time of flow heat-transferring and air-conditioning systems etc.

The above-mentioned factors predetermine more efficient energy and exploitation characteristics of new dynamic energy-saving superconductive flow heat-transferring systems, which will allow revolutionizing of a wide range of applications in numerous fields of flow heat transfer. Furthermore, a possibility of development of various compact modern dynamic components (energy-saving dynamic modules) also allows re-equipping them with existing flow heat-transferring systems as well as their utilization in newly developed dynamic flow heat-transferring systems.

The other examples of new dynamic energy-saving superconductive medium flow technological systems include a wide classification group of a new class of similar energy-saving systems, which provide a "supereffective" spatial structure of outside flow of working zone and cover, without any limitation, for example:

- dynamic fuel systems for different types of internal combustion engines, turboreactive engines, reactive engines etc.;
- dynamic fuel systems for different types of stoves (industrial, household and special usage);
- dynamic fuel systems of gas turbines for production of electricity;
- dynamic dosing components systems (controlling of chemical reactions in different technological processes);
- dynamic dosing systems for special usage (plasma systems for dusting materials, aero- and hydro-acoustic generators etc.).

Examples of similar dynamic technological applications can be, without any limitation, various methods and systems of dynamic energy-saving superconductive flow burning, which are based on the realization of the above-mentioned new proposed modulation method. These new dynamic systems realize a complex of two energy optimization tasks: the above-mentioned dynamic medium flow pipeline transporting and dynamic medium flow spatial structure in a burning working zone (outside flow of the pipeline zone). The known similar flow burning system comprises, for example, at least one action means of non-injected and/or injected fuel (or at least one component of a combustible) flow-forming action (pump); at least one suction pipeline and at least one power pipeline for transporting of said fuel (or at least one component of a combustible) flow in at least one working burning zone. The above-mentioned method of energy optimizing of said flow burning process (realized for example, with the use of at least one above-mentioned energy-saving dynamic module) can comprise modulating of value of fuel flow-forming action of at least one said means and also—above-mentioned optimization of changing of a value of at least one parameter of said modulating in dependence on a change of a value of at least one technological characteristic connected with the flow burning process realizable in said burning zone, for dynamic structural energy optimization, in an energy-effective manner, of the flow burning process.

In the process of realization of the new dynamic method of energy optimizing, in the above-mentioned dynamic energy-saving superconductive flow, burning systems it is possible to use said technological characteristics connected with the energy efficiency of said flow burning process and selected from the group consisting of (without any limitation): an energy consumption of said action means of medium flow-forming action (for example, a pump energy consumption); a dynamic energy parameters of at least one another additional action means of medium flow-forming action and also—a frequency, a range, a law and/or comparative phase of said other additional modulated medium flow-forming energy action; a pressure, a temperature and a rate of at least one non-injected and/or injected component of a combustible (or fuel) flow; a combustible (or fuel) purity; a burning temperature in a combustion chamber; a moment, a duration and a law of injection of at least one component of a combustible (or fuel) injection; energy parameters, a moment, a duration and a law of a component of a combustible (or fuel) ignition in said combustion chamber; a space-temporal flame parameters; a velocity of flame propagation; a combustible ignition temperature; a degree of burning and physical and/or chemical parameters of an exhaust combustion products (mostly, for example, a carbon dioxide, toxic gases and water) etc.

In these cases of the realization of the method of energy optimizing, for example, of fuel (or component of a combustible) flow periodic injection (in said burning zone), the process is an independent predetermined periodic process, which is constructively connected with modulated pipeline fuel (or component of a combustible) flow. The both dynamic processes include providing a predetermined comparative phase shift between predetermined phases of said modulating and said periodic injection, which can be changed by changing a phase of said modulating pipeline fuel (or component of a combustible) flow during said flow burning process in dependence on a change of value of at least one of above-mentioned characteristic. The possibility of optimization control of said predetermined comparative phase shift allows setting and maintaining the average (during the modulation period $T_m$) of the dynamic superconductive energy-effective mode of fuel (or component of a combustible) flow spatial structure in the burning zone.

Besides, said changing a value of at least one parameter of said negative modulating (with the use of proposed phase automatic control, medium flow longitudinal plane waves of the "drop-shaped" form of modulated flow-forming action and energy optimizing criterion) includes providing a mode of maximal value of a burning heat and a minimal value of a general component of a combustible (or fuel) consumption during said flow burning process, simultaneously—which is a superconductive flow burning mode of energy conversion. The modulating of combustible mixture flow in said power pipeline leads to the uniform distribution of components of a combustible over a whole cross section of said combustible mixture flow. The injection of said modulated combustible flow in said burning working zone provides favorable conditions for its burning by significant intensification of said modulated burning process, providing higher degree of fuel burning and so—minimization of the flame length. The fuel flow longitudinal plane waves of the "drop-shaped" form of modulated flow-forming actions propagating through said flow burning system pipelines and said flow burning zone, provide a structural energy 'resonance' response of the whole medium structure of action object by optimization of the dynamic parameters of said modulation. Said structural energy 'resonance' response of turbulent structure and geometry of a dynamic space-temporal burning working zone will provide, in a burning-energy effective manner, maximal velocity and maximal fuel combustion of said component of a combustible (or fuel), which cover all flames, including a laminar and a turbulent burning.

In various cases of the realization of the method of energy optimizing said modulating can include an exterior modulating process, which realizes a principle of controlled exterior dynamic shunting of a selected portion of said suction fuel pipeline and provides a modulating connection of a suction pipeline interior cavity with at least one non-injected and/or injected component of a combustible (or fuel) simultaneously to optimize a dosage and a dynamic space-temporal mixing of different combustible components and said transporting fuel (or at least one component of a combustible) flow in said fuel suction and power pipelines. Besides, said interior modulating process can be used simultaneously with a dependent exterior modulating process. The dependent exterior modulating will realize a principle of controlled exterior dynamic shunting of a selected portion of said suction pipeline. This provides a modulating connection of an interior cavity of suction pipeline with at least one non-injected and/or injected component of a combustible (or fuel) simultaneously for double optimization of a dosage and a dynamic space-temporal mixing of different components of a combustible (or fuel) and said transporting fuel (or at least one component of a combustible) flow in said suction and power pipelines. The exterior modulating process can include providing of at least one predetermined parameter of said exterior modulating selected from the group consisting of: a frequency, a range, a law and comparative phase shift of said dependent modulating, comprising an exterior modulation of a discrete input and an optimization parametric input. The exterior modulating process includes providing a predetermined comparative phase shift for adjusting a moment of at least one injected component of a combustible (or fuel) injection during said burning process or providing a predetermined comparative phase shift for said interior modulating process during said burning process.

The above-mentioned new dynamic energy-saving superconductive flow burning systems, realizing the proposed new modulation principles of the energy optimization of the different flow burning process, will provide the following qualitatively new advantages, for example:

- continuous action of a mechanism of hydrodynamic instability progress of elementary fluid particles in the turbulent flow and flame;
- higher degree of fuel burning;
- greater effective combustion of difficult-to-burn fuels;
- optimal flame turbulence structure corresponding to maximal value of heat emission flux;
- minimization of a flame length;
- minimization of a fuel consumption;
- significant minimization of CO and $No_x$ emissions;
- decrease of length of a burner liner;
- decrease of sizes of the burning chamber etc.

Said factors predetermine higher efficiency of the energy and exploitation characteristics of new dynamic energy-saving superconductive flow burning systems, which will allow revolutionizing a wide range of applications in numerous industrial fields. Furthermore, the possibility of development of various compact modern dynamic components (energy-saving dynamic modules) also allows re-equipping the existing flow burning systems, as well as their utilization in newly developed dynamic flow burning systems.

The examples of the use of newly developing dynamic energy-saving superconductive flow burning systems cover, without any limitation, for example: cracking, coking, blast, reforming, gas, glass furnaces, heater processes for petroleum refining and petrol-chemical industries, aviation and rocket systems (turboreactive and reactive engines), steam generation processes for production of power and electricity, dosed special destination systems (example, plasma systems for dusting different materials, aero- and hydro-acoustic generators), boiler and domestic heater systems etc.

An interesting example of similar dynamic systems can be, without any limitation, various systems of dynamic energy-saving superconductive flow of the internal combustion engine, based on the realization of the above-mentioned new proposed modulation method. These new dynamic systems realize the complex of two energy optimization tasks: the above-mentioned dynamic medium flow pipeline transporting and dynamic medium flow spatial structure in a combustion chamber of an engine cylinder block (outside flow of pipeline zone). Known similar flow internal combustion engine system comprises, for example, at least one means of injected fuel flow-forming action (a pump), at least one suction pipeline and at least one power pipeline for transporting of said fuel flow, at least one cylinder block including at least one fuel injection valve for adjusting a moment, a duration and a law of a fuel injection in at least one combustion chamber of said cylinder block with at least one movable piston and a spark plug for adjusting energy parameters, a moment, a duration and a law of an injected fuel ignition into said combustion chamber. The above-mentioned method of dynamic energy optimizing of said flow process (realized for example, with use of at least one above-mentioned energy-saving dynamic module) can comprise modulating of a value of at least one fuel flow-forming action of at least one action means and also—above-mentioned optimization changing a value of at least one parameter of said modulating in dependence on a change of a value of at least one technological characteristic connected with a process of energy converting realizable in said combustion chamber of a cylinder of the engine block, for dynamic space-temporal and structural energy optimization, in an energy-effective manner, of said energy converting process.

In the process of realization of the new dynamic method of energy optimizing in the above-mentioned dynamic energy-saving superconductive flow of the internal combustion engine systems it is possible to use said technological characteristic connected with the energy efficiency of said flow energy converting process, selected from the group consisting of (without any limitation): an energy consumption of said means of injected fuel flow-forming action (a pump energy consumption); a power, a temperature and a rate of said injected fuel flow; a temperature in said combustion chamber; a moment, duration and law of said fuel injection; energy parameters, such as moment, duration and law of injected fuel ignition; a velocity of movable piston; a physical and/or chemical parameters of exhaust combustion products (mostly, for example, carbon dioxide, toxic gases and water), etc.

In these cases of realization of the method of energy optimizing for example, the modulated fuel flow periodic injection process (in said combustion chamber of cylinder of the engine block) is an independent predetermined periodic process, which is constructively connected with the modulated pipeline fuel flow. Another independent predetermined periodic process, which is constructively connected with the modulated pipeline fuel flow, can be a periodic ignition process of injected fuel. Said three dynamic processes includes the providing of predetermined comparative phase shifts between a predetermined phases of said modulating of pipeline fuel flow, said periodic injection of modulated fuel flow and said periodic injected fuel ignition, accordingly, which can change by changing of the phase of said modulating during said process of energy converting of fuel flow in dependence on a change of value at least one of above-mentioned characteristic. Said change of phase of said modulating provides a predetermined comparative phase shift for adjusting of said moment of fuel injection and said moment of fuel ignition, simultaneously with fuel flow longitudinal plane waves of the "drop-shaped" form of modulated flow-forming action. A possibility of optimization control of said predetermined comparative phase shifts allows setting and maintaining on average (during the modulation period $T_m$) the dynamic superconductive energy-effective state of fuel flow spatial structure in said combustion chamber of engine cylinder block.

Besides, said changing a value of at least one parameter of said negative modulating (with the use of the proposed phase automatic control, medium flow longitudinal plane waves of the "drop-shaped" form of modulated flow-forming action and energy optimizing criterion) includes providing a mode of a maximal value of velocity of said movable piston and a minimal value of a fuel consumption of said internal combustion engine during said fuel flow energy converting process, simultaneously—which is a superconductive energy mode. Herewith, fuel flow longitudinal plane waves of the "drop-shaped" form of modulated flow-forming actions are propagated through said internal combustion engine system (fuel flow pipelines and fuel flow combustion chamber of engine cylinder block) and provide a structural energy 'resonance' response of whole medium structure action object by optimization of the dynamic parameters of said fuel flow modulation. Herewith, during the process of compressing of a volume of modulated fuel flow in said burning chamber elementary particles of fuel mixture are disrupted almost to a molecular level. The intensity of turbulent chaotic movement of particles is significantly increased, that leads to increase of a mixing intensity and to provide a uniform mixture distribution (and as a consequence—significant decrease of a distributed mixture volume viscosity) over a whole volume of said burning chamber. This leads to significant decrease of a time of preparation of combustible mixture during said compressing process and to providing of favorable conditions to minimize the burning time during said burning process. Said structural energy 'resonance' response of the turbulent structure and geometry of a dynamic space-temporal injecting of fuel in burning working zone in said combustion chamber of internal combustion engine will provide, in an energy-effective high temperature-velocity manner, maximal velocity and maximal full injection of fuel flow in the combustion chamber, covering all kinds of the flames, including a laminar and turbulent burning.

In various cases of the realization of the method of energy optimizing said modulating can include a co-called exterior modulating process, which realizes a principle of controlled exterior dynamic shunting of a selected portion of said fuel flow suction pipeline and provides a modulating connection of an interior cavity of suction pipeline with at least one injected fuel mix component, simultaneously to optimize a dosage and a dynamic space-temporal mixing of different components of a combustible and transporting of fuel flow in said fuel flow suction and power pipelines.

The above-mentioned factors predetermine more efficient energy, exploitation and ecological characteristics of new dynamic energy-saving superconductive flow internal combustion engine systems, which will allow revolutionizing a wide range of applications in numerous industrial fields.

Other interesting examples of new development dynamic energy-saving superconductive medium flow technological systems include three wide classification groups of a new class of similar energy-saving systems, without any limitation, for example:

- dynamic so-called "structurally connected" turbine, turbo-reactive or reactive engines for high speed apparatuses (aircrafts, helicopters, rockets, reactive cars, sport cars, boats, ships, submarines and etc.), or dynamic "structurally connected" systems of engines for space apparatuses of special usage, which provide a dynamic energy-saving superconductive medium flow transporting an object in said dynamic "structurally connected" system;
- dynamic so-called "surface-energy" systems, which structurally realize the principle of so-called "breathing surfaces" on structural part of bodies of high speed apparatuses, or the dynamic "surface-energy" systems, which structurally realize the principle of aero- or hydrodynamic surface-distributed controlled so-called "dynamic rudders" on the wings or empennage of said different high speed apparatuses, for providing the dynamic "supereffective" aero- or hydrodynamic characteristics of said dynamic "surface-energy" systems; and also
- dynamic energy-saving superconductive "explosive" systems, which realize the "supereffective" aero- or hydrodynamic characteristics of dynamic medium flow action (spatial, barrel or special) on the object, as disclosed for example in U.S. Pat. No. 6,827,528 (2004)—A. Relin.

In these cases of the realization of the method of energy optimizing the above-mentioned independent predetermined periodic processes can include practically all the above-mentioned variants (directly connected with said general modulated medium flow, connected with said general modulated medium flow across at least one medium flow action working zone including at least one medium flow action object, connected with said general modulated medium flow which is constructively separated from said modulated medium flow periodic process, said periodic process is a periodic injection of said modulated medium flow inside at least one working zone, said periodic process is a periodic energy action on said modulated medium flow which is injected into at least one working zone for realization of energy converting process etc.) and also—specific variants, without any limitation, for example:

- providing modulating of a value of a medium flow-forming action of at least one additional action means of medium flow-forming action connected with an additional modulated medium flow, which is constructively separated from said general modulated medium flow (for example, in the above-mentioned high speed or space apparatuses with at least two the dynamic so-called "structurally connected" turbine, turbo-reactive or reactive engines); or/and
- providing modulating of a value of a medium flow-forming action of at least one additional means of a medium flow-forming action interacted with an additional modulated medium flow, which is constructively directly not connected with said general modulated medium flow (for example, in the above-mentioned dynamic energy-saving superconductive "explosive" system including at least two constructively directly not interconnected similar dynamic "explosive" subsystems, which realize the "supereffective" dynamic medium flow spatial actions on the object, simultaneously).

The dynamic processes include providing a predetermined comparative phase shift between predetermined phases of said general flow modulating and at least one additional periodic process, which can be changed by changing a phase of said modulating in dependence on a change of value at least one of the technological characteristics during realization of both above-mentioned dynamic processes. A possibility of optimization control of said predetermined comparative phase shift (with the use of proposed medium flow longitudinal plane waves of the "drop-shaped" form of modulated flow-forming action and energy optimizing criterion) allows, for example, setting and maintaining on average (during the modulation period $T_m$) the dynamic superconductive energy-effective state of said realizable dynamic process (accompanied by dramatic decrease of aero- or hydrodynamic resistance of realizable modulated flows) or to provide the dynamic synchronization of a work of "structurally connected" turbo-reactive engines in the above-mentioned high speed apparatuses.

The above-mentioned fundamentally new possibilities predetermine more efficient energy, exploitation and ecological characteristics of new similar dynamic energy-saving superconductive systems, which also will allow revolutionizing a wide range of applications in numerous industrial fields.

At the same time, the proposed dynamic energy-saving superconductive method can be efficiently realized not only in these systems, which use the above-mentioned types of pressure drop means as the flow-forming action means acting on the carrying medium. The inventive method can be efficiently realized in the "energy" systems, which use as the means of action on the carrying medium—a means of direct energy action (magneto-hydrodynamic pumps, magnetic and electromagnetic accelerating systems etc.). In the means of flow-forming action the energy supplied to them (or several types of energy) is converted directly into a direct energy action on the carrying medium for creating its flow. As the supplied energy it is possible to use for example: electrical, electromagnetic, magnetic etc. energy, or a combination of several types of energy (for example a combination of magnetic and electrical energy as in a magneto-hydrodynamic pumps).

In these "energy" systems the modulation of the value of the flow-forming action in the means of direct energy action (with the use of proposed phase automatic control, medium flow longitudinal plane waves of the "drop-shaped" form of modulated flow-forming action and energy optimizing criterion) can be performed by providing of controlled predetermined periodic changes of a value of at least one parameter, dynamically connected with a process of a conversion of a consumption energy into said modulated medium flow-forming action realizable in said means of medium flow-forming direct energy action, as disclosed for example in U.S. Pat. No. 6,827,528 (2004)—A. Relin.

For example in a magneto-hydrodynamic pump, it is possible to use as the changing conversion parameter: an induction of a magnetic field or an electrical voltage, applied to a portion of the carrying medium flow; an additional resistance introduced into an electrical circuit in series with the above-mentioned portion of the carrying medium flow; etc. In this case for realization of the inventive dynamic energy-saving superconductive method, the magneto-hydrodynamic pump must be additionally equipped with a special "parametric energy-saving dynamic module" for the given dynamic periodic changes of the value of the selected above-mentioned at least one conversion parameter.

In such "energy" systems, the optimization of control of the modulation is also connected with the use of some of the controlled characteristics, which reflect the process of transporting of the object with the flow of carrying medium. These systems can include various "beam" systems of conversion of energy, gas flow systems with the use of a magneto-hydrodynamic generator, etc. The efficiency of the use in such "energy" systems of the proposed inventive method can be connected with the increase of the converted (into other type) energy and also with the increase of parameters characterizing its quality. The latter is determined by a possibility of minimization of the influence on the process of conversion of turbulent factors and also—by the dynamic nature of movement of the particles of modulated medium flow.

At the same time, this approach to provide the modulation with the use of various types of the special "parametric energy-saving dynamic module" can be efficiently used in some of the above-mentioned systems, which have the pressure drop means as the medium flow-forming action means. In this case, as the changing conversion parameter it is possible to use, for example: electrical, electromagnetic, magnetic, technical, physical, chemical, physical-chemical parameters or a combination of several of these or other parameters. The parameter (parameters) can be selected with the consideration of the type of the supplied energy and the principle of action of the pressure drop means. This can be a functionally-structural or energy conversion parameter, which is connected dynamically with the process of conversion of the supplied energy into the medium flow-forming action and significantly directly acting on the process of conversion with its given change. The function of the "parametric energy-saving dynamic module" can be realized in various variants of dynamic control devices, which provide a possibility of the given dynamic periodic change of the value of the selected "modulated" conversion parameter, for example with the use of dynamic electromagnetic coupling, on the basis of special modulators of "position" of functional structural elements of the action means; or—of the special modulators of its main energy parameters; etc. Therefore, the above-mentioned approach with the use of various types of special devices of "parametric energy-saving dynamic module" as a methodological solution in performing of modulation of the value of the medium flow-forming action can be used also in various action means for the realization of the new proposed dynamic energy-saving superconductive medium flow transporting "energy" systems.

The above-mentioned analysis of all examples of several possible efficient use of the proposed energy-saving superconductive optimization method persuasively illustrates the common most characteristic decisive and distinctive features of the present invention. In turn the above-mentioned advantages of the proposed inventive method open wide possibilities to create a principally new class of energy-saving superconductive dynamically controlled medium flow transporting systems, which provide efficient energy and exploitation characteristics of various processes of transporting of medium flow. This reflects the possibility of a transition of the traditional processes of transporting of medium flow to a qualitatively new step of their development. This step of development will be characterized by a wide use of the dynamic energy-saving superconductive medium flow transporting technologies, connected with the new above-mentioned dynamic flow-forming actions on the carrying medium and also—with dynamic, multi-parameter optimization control, which uses a current control of dynamic technological characteristics of such processes of dynamic transporting of various objects by a dynamically created flow of carrying medium.

The dimensions and production cost of the energy-saving dynamic modules (in the above-mentioned cases) will not exceed a small part (twenty-thirty percents) of the dimensions and total price of the corresponding pumping systems consisting of the pump, the drive and the controlling block. The energy-saving dynamic modules (realizing said above-mentioned negative optimization modulating with the use of automatic control of the proposed phase, medium flow longitudinal plane waves of the "drop-shaped" form of modulated flow-forming action and energy optimizing criterion) can be designed and produced in various types of structural shapes depending on a power of the pumps or pumping systems, a pipeline transporting structure (length, diameter, pressure, flow capacity etc.), different flow media and use of different functional modifications (for one-parametric or multi-parametric optimization of dynamic process). Besides, it should be noted that, an inlet of the longer inlet portion of a module shunt canal 6 (see FIG. 2) can be dynamically protected by an additional filtering element (as described in detail, for example in our above-mentioned U.S. patent). A number of the energy-saving dynamic modules to be manufactured may reach millions of pieces for existing and new class of various medium flow pipeline transporting systems. Therefore, a potential entire market for the energy-saving dynamic module and new dynamic systems may be estimated at multi-billion dollar level.

In the future, parallel with the development and manufacturing of the energy-saving dynamic modules, new dynamic microprocessor means (or systems) of the flow-forming action—the energy-saving dynamic pumps (as dynamic controlled "generator" of the flow-forming actions on the carrying medium flow) will be created. Such energy-saving dynamic pumps will include the new constructive conjugation between the means of flow-forming action (for example, a pump) and all above-listed basic functional components of the energy-saving dynamic module. Similar energy-saving dynamic pumps can also be created with different functional modifications (for instance, for one-parametric or multi-parametric controlling) and also—for different parameters of pipelines and flow of carrying medium. The needs for similar energy-saving dynamic pumps will be predefined by a quantity of introduced new different dynamic energy-saving superconductive medium flow transporting systems and also—by a possible volume of conversion of the old pumps into new energy-saving dynamic pumps in the running medium flow pipeline transporting systems. The needed in the future amount of the energy-saving dynamic pumps may also reach millions of units and their total market price—billions of dollars.

At the same time, the new above-mentioned energy-saving dynamic module (connected with pump) and the energy-saving dynamic pump additionally can provide the function of dynamically controlled pipeline "valve". Said function can provide, for example, a given change of position of the above-mentioned control element 23, in the cylindrical valve block, of the energy-saving dynamic module 5, a predetermined given change of a value of the pipeline medium flow rate by the given "shunting" change of the pump pressure value. A similar function of the dynamic controlled pipeline "valve" allows, without additional change of the working pipeline cross-section, providing an extra decrease of pump energy consumption.

Therefore, the discovered by authors (in Remco International, Inc., PA, USA) above-mentioned new energy optimization design principles of the development of the energy-saving dynamic module and the energy-saving dynamic pumps for realization of the different dynamic energy-saving superconductive medium flow transporting technologies will provide on the market in principle a new class of various modern, intelligent dynamic energy-saving products, which do not have analogs in the world market. One of the very important advantages in applying dynamic energy-saving technologies is that all running pipelines and pump systems do not change. It is sufficient only to adjust the energy-saving dynamic module with a running pump in the existing medium flow transporting system.

The development of above-mentioned new dynamic energy-saving superconductive medium flow transporting technologies, which realize the above-mentioned energy hydrodynamic superconductivity phenomenon, can be compared with application of electric superconductivity phenomenon, from the energy-saving point of view. During 100 years since it was discovered, billions of dollars were spent for carrying out the experimental and theoretical research. But until present time, this phenomenon does not have wide practical applications, because the accessible superconductors have not yet been created. Moreover, even if such superconductors will be created (may be during the near fifty years), it will be necessary to change the electrical conductors to the new superconductors in all networks and equipment (such as, generators, motors and transformers and others). As a result of this possible very expensive and long-term exchange of the electrical conductors with the new superconductors the electric energy economy can reach no more than five percent of the whole world energy market. At the same time, the implementation of the development of above-mentioned new dynamic energy-saving superconductive medium flow transporting technologies can start in three years and are practically, without alternative, energy-saving technologies for the whole energy world market. This will be accompanied by minimum cost for further development and subsequent implementation of new unique break-through dynamic energy-saving technologies with maximum preservation of already existing large energy consumption technological infrastructures, which cover up to seventy percent of the world's industries.

Besides, the new dynamic energy-saving superconductive medium flow transporting technologies guarantee a decrease of electrical energy consumption by billions kilowatt-hours per year. Taking into consideration that the energy capacity share of similar technologies is higher than fifty percent of energy consumption of the world market, the economy of energy and energy resources can reach about thirty percent of whole world energy market, and their total market price—hundreds of billions of dollars. Said advantages will predetermine the considerable decrease (two-three times) of the specific price of dynamic energy-saving flow transporting of different materials and media, and also—will have a significant influence on the decrease of prices of energy resources and industrial products.

Realization of the developed revolutionary dynamic energy-saving superconductive medium flow transporting technologies will allow opening wide possibilities to create a principally new class of industrial dynamically controlled systems, which provide efficiency of energy and operating characteristics of various processes of transporting of object with a flow of carrying medium. This provides a possibility to have a transition of traditional industrial processes of transporting to a qualitatively new step of their development. In fact, these technologies may become a standard for different industries in twenty first century and will mark a new era of the technical evolution in energy-saving transporting technologies, based on the superconductivity of medium flows. As a result of this conversion, a tremendous saving of energy resources, new technological, exploitative, quality and price-forming possibilities for various applications in the multi-billion dollar market across the globe, can be achieved. In addition, this also determines a possibility of obtaining a multi-billion dollar economic effect connected with the solution of known energy, humanitarian, ecological and social world problems.

It will be understood that each of the elements described above, or two or more together, may also find a useful application in other types of methods and devices differing from the types described above.

While the invention has been illustrated and described as embodied in the new method of dynamic energy-saving superconductive transporting of medium flow, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a system for dynamic transporting of a medium flow having an entrained material comprising an action means and a dynamic module configured and operable to provide, through outputs of said action means, modulated by said module a cycle having maximum and minimum values of an output on said medium flow by said action means, a method of optimizing a value of at least one characteristic of said flow with respect to the energy efficiency of said flow comprising the steps of:

modulating by said dynamic module a value of said output to provide said cycle, which forms longitudinal waves of said output on said medium flow during said modulating, which modulating includes:

selecting a frequency of said modulating to provide a period of said modulating and to provide said longitudinal waves of said output as longitudinal plane waves, providing a range of said modulating to carry a maximum change of said value of said output on said medium flow in said period of said modulating, providing a law of said modulating comprising a front time and a back time to create a drop-shaped form comprising a front part and a back part of said change of said value of said output on said medium flow during said period of said modulating by providing said front time for creating said front part of said drop-shaped form of said law of said modulating by selecting a time ratio of said front time to said period of said modulating more than 0 and less than 0.5, decreasing said output from said maximum value by a value of said range bounded in said modulating to said minimum value during said front time for creating said front part of said drop-shaped form by changing said front part to a form of a quarter ellipse curve such that a horizontal axis of an ellipse coincides with a horizontal axis of said drop-shaped form, and recovering said output from said minimum value to said maximum value during said back time for creating said back part of said drop-shaped form by changing said back part to a form of a degree function curve such that an initial value of said degree function curve coincides with an ending value of said quarter ellipse curve;

controlling an acting value of said output on said medium flow during said modulating by controlling an acting value of at least one energy parameter connected with a value of an energy consumption of said action means, and evaluating said controlled acting value of said output with the use of said controlled acting value of said energy parameter;

controlling an acting value of a kinetic energy of said medium flow during said modulating by controlling an acting value of a velocity independent of said controlling of said acting value of at least one energy parameter of said medium flow, controlling an acting value of a density of said medium flow, and evaluating said controlled acting value of said kinetic energy with the use of said controlled acting value of said velocity and said controlled acting value of said density;

evaluating a value of an energy ratio of said controlled acting value of said output on said medium flow to said controlled acting value of said kinetic energy of said medium flow during said modulating; and changing a value of at least one of said recited parameters of said modulating selected from a group consisting of said frequency, said range, said law and said time ratio of said modulating such that a minimum value of said energy ratio is provided and thereby said value of at least one characteristic of said flow with respect to the energy efficiency of said flow is optimized.

2. A method of optimizing as defined in claim 1, further comprising interacting said medium flow with at least one object during said modulating.

3. A method of optimizing as defined in claim 1, further comprising directly interacting said medium flow with at least one independent periodic process having a frequency, a range, a law and a phase of a change of an output on said medium flow during said modulating.

4. A method of optimizing as defined in claim 1, further comprising interacting, through at least one object, said medium flow with at least one independent periodic process having a frequency, a range, a law and a phase of a change of an output on said medium flow during said modulating.

5. A method of optimizing as defined in claims 3 and 4, further comprising carrying out a dynamic structural energy optimization of said interacting by changing a value of a phase of said modulating.

* * * * *